United States Patent [19]

Spitzer et al.

[11] 4,124,149

[45] Nov. 7, 1978

[54] AEROSOL CONTAINER WITH POSITION-SENSITIVE SHUT-OFF VALVE

[76] Inventors: Joseph G. Spitzer, 44 Coconut Row, Palm Beach, Fla. 33480; Marvin Small, 1100 Park Ave., New York, N.Y. 10028; Lloyd I. Osipow, 2 Fifth Ave., New York, N.Y. 10003; Dorothea C. Marra, 107 Fernwood Rd., Summit, N.J. 07901

[21] Appl. No.: 754,471

[22] Filed: Dec. 27, 1976

Related U.S. Application Data

[63] Continuation-in-part of Ser. No. 706,857, Jul. 19, 1976, abandoned.

[51] Int. Cl.[2] ..... B65D 83/14

[52] U.S. Cl. ..... 222/402.19; 222/402.18

[58] Field of Search ..... 222/94, 95, 402.1, 402.18, 222/402.19, 402.24; 137/43

[56] References Cited

U.S. PATENT DOCUMENTS

| | | | |
|---|---|---|---|
| 2,778,543 | 1/1957 | Urlaub | 222/402.11 X |
| 2,793,794 | 5/1957 | Samuel | 222/402.19 |
| 2,968,428 | 1/1961 | Samuel | 222/402.19 |
| 3,372,845 | 3/1968 | Frangos | 222/402.18 |
| 3,472,531 | 10/1969 | Evesgue | 137/43 X |
| 3,542,254 | 1/1970 | Samuelson | 222/402.19 |

*Primary Examiner*—Robert B. Reeves
*Assistant Examiner*—David A. Scherbel

[57] ABSTRACT

An aerosol container is provided, especially intended for use with compositions containing liquefied flammable propellants, and having a shut-off valve closing off flow through an open manually-operated delivery valve whenever the container is tipped from the upright position beyond the horizontal towards the fully inverted position, the container comprising, in combination, a pressurizable container having at least one storage compartment for an aerosol composition and a liquefied propellant in which compartment propellant can assume an orientation according to orientation of the container between a horizontal and an upright position, and a horizontal and inverted position; a delivery valve movable manually between open and closed positions, and including a valve stem and a delivery port; an aerosol-conveying passage in flow connection at one end with the storage compartment and at the other end with the delivery port, manipulation of the delivery valve opening and closing the passage to flow of aerosol composition and propellant from the storage compartment to the delivery port; and a shut-off valve responsive to orientation of the container to move automatically between positions opening and closing off flow of propellant to the delivery port, the shut-off valve moving into an open position in an orientation of the container between a horizontal and an upright position, and moving into a closed position in an orientation of the container between the horizontal and an inverted position.

41 Claims, 17 Drawing Figures

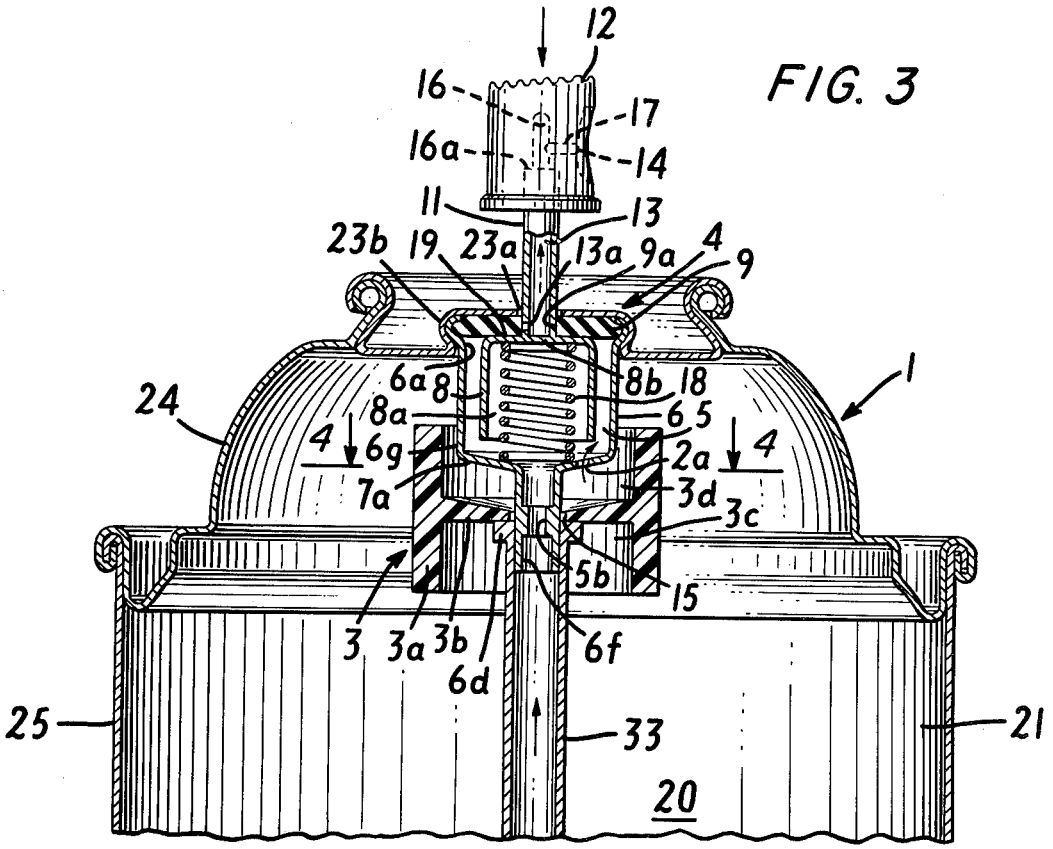
FIG. 3
FIG. 4
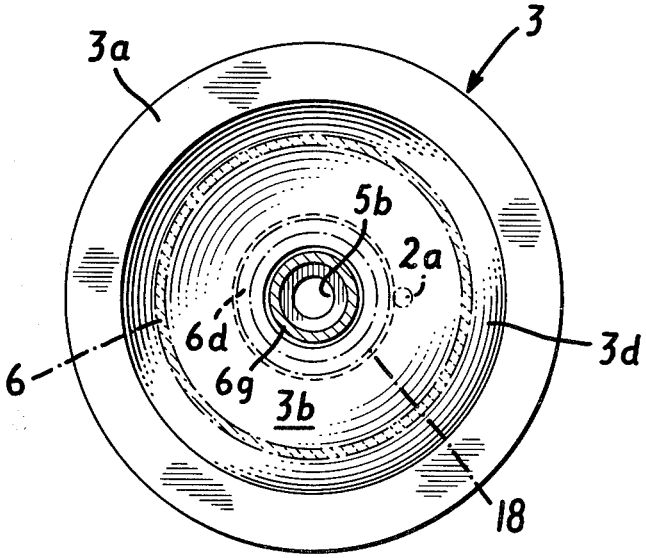

AEROSOL CONTAINER WITH POSITION-SENSITIVE SHUT-OFF VALVE

This application is a continuation-in-part of Ser. No. 706,857, filed July 19, 1976, now abandoned.

Aerosol sprays are now widely used, particularly in the cosmetic, topical pharmaceutical and detergent fields, for delivery of an additive such as a cosmetic, pharmaceutical, or cleaning composition to a substrate such as the skin or other surface to be treated. Aerosol compositions are widely used as antiperspirants, deodorants, and hair sprays to direct the products to the skin or hair in the form of a finely-divided spray.

Much effort has been directed to the design of valves and valve delivery ports, nozzles or orifices or orifices which are capable of delivering finely-divided sprays, of which U.S. Pat. Nos. 3,083,917 and 3,083,918 patented Apr. 2, 1963, to Abplanalp et al, and No. 3,544,258, dated Dec. 1, 1970, to Presant et al, are exemplary. The latter patent describes a type of valve which is now rather common, giving a finely atomized spray, and having a vapor tap, which includes a mixing chamber provided with separate openings for the vapor phase and the liquid phase to be dispensed into the chamber, in combination with a valve actuator or button of the mechanical breakup type. Such valves provide a soft spray with a swirling motion. Another design of valves of this type is described in U.S. Pat. No. 2,767,023. Valves with vapor taps are generally used where the spray is to be applied directly to the skin, since the spray is less cold.

Marsh U.S. Pat. No. 3,148,127 patented Sept. 8, 1964 describes a pressurized self-dispensing package of ingredients for use as a hair spray and comprising isobutane or similar propellant in one phase and an aqueous phase including the hair setting ingredient. The isobutane is in a relatively high proportion to the aqueous phase, and is exhausted slightly before the water phase has been entirely dispensed. A vapor tap type of valve is used having a 0.030 inch vapor tap orifice, a 0.030 inch liquid tap orifice, and a 0.018 inch valve stem orifice, with a mechanical breakup button. There is no disclosure of the relative proportions of propellant gas to liquid phase being dispensed. Rabussier U.S. Pat. No. 3,260,421 patented July 12, 1966 describes an aerosol container for expelling an aqueous phase and a propellant phase, fitted with a vapor tap valve, and capillary dip tube. To achieve better blending of the phases before expulsion, the capillary dip tube is provided with a plurality of perforations 0.01 to 1.2 mm in diameter over its entire length, so that the two phases are admitted together in the valve chamber from the capillary dip tube, instead of the gas being admitted only through a vapor tap orifice, and the liquid through a dip tube as is normal. The propellant is blended in the liquid phase in an indeterminate volume in proportion to the aqueous phase in the capillary dip tube.

Presant et al in U.S. Pat. No. 3,544,258, referred to above, discloses a vapor tap valve having a stem orifice 0.018 inch in diameter, a vapor tap 0.023 inch in diameter with a capillary dip tube 0.050 inch in diameter. The button orifice diameter is 0.016 inch. The composition dispensed is an aluminum antiperspirant comprising aluminum chlorhydroxide, water, alcohol and dimethyl ether. The aluminum chlorhydroxide is in solution in the water, and there is therefore only one liquid phase. The dimensions of the orifices provided for this composition are too small to avoid clogging, in dispensing an aluminum antiperspirant composition containing dispersed astringent salt particles.

The vapor tap type of valve is effective in providing fine sprays. However, it requires a high proportion of propellant, relative to the amount of active ingredients dispensed per unit time. A vapor tap requires a large amount of propellant gas, because the tap introduces more propellant gas into each squirt of liquid. Such valves therefore require aerosol compositions having a rather high proportion of propellant. A high propellant proportion is undesirable, however. The fluorocarbon propellants are thought to be deleterious, in that they are believed to accumulate in the stratosphere, where they may possibly interfere with the protective ozone layer there. The hydrocarbon propellants are flammable, and their proportion must be restricted to avoid a flame hazard. Moreover, both these types of propellants, and especially the fluorocarbons, have become rather expensive.

Another problem with such valves is that since they deliver a liquid propellant-aerosol composition mixture, and have valve passages in which a residue of liquid remains following the squirt, evaporation of the liquid in the valve passages after the squirt may lead to deposition of solid materials upon evaporation of liquids, and valve clogging. This problem has given rise to a number of expedients, to prevent the deposition of solid materials in a form which can result in clogging.

Consequently, it has long been the practice to employ large amounts of liquefied propellant, say 50% by weight or more, to obtain fine droplets of liquid sprays or fine powder sprays, and a rather small solids content, certainly less than 10%, and normally less than 5%. The fine sprays result from the violent boiling of the liquefied propellant after it has left the container. A case in point is exemplified by the dispersion-type aerosol antiperspirants, which contain 5% or less of astringent powder dispersed in liquefied propellant. It has not been possible to use substantially higher concentrations of astringents without encountering severe clogging problems.

There is considerable current interest in the substitution of compressed gases for fluorocarbons and hydrocarbons as propellants to obtain fine aerosol sprays. The reasons include the low cost of compressed gases, the flammability of liquefied hydrocarbon propellants, and the theorized hazard to the ozone layer of liquefied fluorocarbon propellants. Reasonably fine sprays of alcoholic solutions have been obtained using carbon dioxide at 90 psig and valving systems with very fine orifices. These orifices are so small that dispersed solids cannot be tolerated, and even inadvertent contamination with dust will cause clogging. Thus, a typical system will employ a 0.014 inch capillary dip tube, a 0.010 inch valve stem orifice, and a 0.008 inch orifice in a mechanical break-up actuator button. However, only limited variations in delivery rates are possible, since the use of significantly larger orifices will coarsen the spray droplets. Moreover, these fine sprays of alcoholic solutions are flammable.

Thus far, the art has not succeeded in obtaining fine aerosol sprays using aqueous solutions with compressed gases. The reasons for this are that water has a higher surface tension than alcohol (ethanol or isopropanol) and is also a poorer solvent for the compressed gases, particularly carbon dioxide, which is preferred. All of these factors adversely affect the break-up of droplets to form a fine spray.

Special designs of the delivery port and valve passages have been proposed, to prevent the deposit of solid materials in a manner such that clogging can result. U.S. Pat. No. 3,544,258 provides a structure which is especially designed to avoid this difficulty, for example. Such designs result however in a container and valve system which is rather expensive to produce, complicated to assemble because of the numerous parts, and more prone to failure because of its complexity.

In accordance with U.S. Pat. No. 3,970,219, of which this application is a continuation-in-part, aerosol containers are provided that are capable of delivering a foamed aerosol composition. The aerosol composition is foamed inside the aerosol container, and delivered through the valve of the aerosol container as a foam or collapsed foam. Fine droplets are formed from the foamed aerosol compositions, due at least in part to collapse of thin foam cell walls into fine droplets. The propellant serves to foam the liquid within the container, forming a foamed aerosol composition, and propels from the container through the valve and delivery port both any foam and any droplets that form when the foam collapses.

With conventional aerosol containers, a substantial proportion of the propellant is in liquid form as the aerosol composition passes through the valve and delivery port. Propellant evaporates as the spray travels through the air, and it continues to evaporate after the spray has landed on a surface. The heat of vaporization is taken from the surface, and the spray consequently feels cold. This is wasteful of propellant, as is readily evidenced by the coldness of sprays from conventional aerosol containers. In contrast, in the invention of U.S. Pat. No. 3,970,219, the propellant is in gaseous form when expelled with the liquid. The propellant is not wasted, therefore, and since there is substantially no liquid propellant to take up heat upon vaporization, the spray is not cold.

The aerosol containers in accordance with the invention of U.S. Pat. No. 3,970,219 accordingly foam an aerosol composition therein prior to expulsion from the container, and then expel the resulting foamed aerosol composition. These aerosol containers comprise, in combination, a pressurizable container having a valve movable between open and closed positions, with a valve stem, and a foam-conveying passage therethrough, in flow connection with a delivery port; bias means for holding the valve in a closed position; and means for manipulating the valve against the bias means to an open position, for expulsion of aerosol composition foamed within the container via the valve passage and delivery port; means defining at least two separate compartments in the container, of which a first compartment is in direct flow connection with the valve passage, and a second compartment is in flow connection with the valve passage only via the first compartment; and porous bubbler means having through pores interposed between the first and second compartments with the through pores communicating the compartments, the pores being of sufficiently small dimensions to restrict flow of propellant gas from the second compartment therethrough and form bubbles of such gas in liquid aerosol composition across the line of flow from the bubbler to the valve, thereby to foam the aerosol composition upon opening of the valve to atmospheric pressure, and to expel foamed aerosol composition through the open valve.

U.S. patent application Ser. No. 670,913, filed Mar. 26, 1976, now U.S. Pat. No. 4,019,657 patented Apr. 26, 1977 provides another form of foam-type aerosol container, in which the aerosol composition therein is foamed prior to expulsion from the container, and then the resulting foamed aerosol composition is expelled. These aerosol containers comprise, in combination, a pressurizable container having a valve movable between open and closed positions, with a valve stem, and a foam-conveying passage therethrough, in flow connection with a delivery port; bias means for holding the valve in a closed position; and means for manipulating the valve against the bias means to an open position for expulsion via the valve passage and delivery port of aerosol composition foamed within the container; means defining at least two separate compartments in the container, of which a first compartment has a volume of at least 0.5 cc and is in direct flow connection with the valve passage, and a second compartment is in flow connection with the valve passage only via the first compartment; at least one first liquid tap orifice having a diameter within the range from about 0.012 to about 0.2 cm and communicating the first and another compartment for flow of liquid aerosol composition into the first compartment, and of sufficiently small dimensions to restrict flow of liquid aerosol composition therethrough; the ratio of first compartment volume/first orifice diameter being from about 10 and preferably from about 20 to about 400, and preferably about 200, where $x$ is 1 when the the orifice length is less than 1 cm, and 2 when the orifice length is 1 cm or more; at least one second gas tap orifice having a total cross-sectional open area within the range from about $7 \times 10^{-6}$ to about $20 \times 10^{-4}$in$^2$ ($4 \times 10^{-5}$ to $1.3 \times 10^{-2}$cm$^2$), a single orifice having a diameter within the range from about 0.003 to about 0.05 inch (0.007 to 0.13 cm) and communicating the first and second compartments for flow of propellant gas into the first compartment from the second compartment therethrough, and of sufficiently small dimensions to restrict flow of propellant gas and form bubbles of such gas in liquid aerosol composition across the line of flow thereof to the valve, thereby to foam the aerosol composition upon opening of the valve to atmospheric pressure, and to expel the foamed aerosol composition through the open valve.

The advantages of foaming the aerosol composition within the container are twofold. Because the propellant is in gaseous form (having been converted to gas in the foaming) there is no liquid propellant to expel, so all propellant is usefully converted into gas, for propulsion and foaming, before being expelled. Because the foamed liquid aerosol composition has a higher volume than the liquid composition, and the expulsion rate is in terms of volume per unit time, less liquid is expelled per unit time. Thus, in effect, the liquid is expelled at a lower delivery rate, which conserves propellant per unit squirt, and means a higher active concentration must be used, to obtain an equivalent delivery rate of active ingredient. Also, since there is less liquid, there is a negligible clogging problem, even at a two or three times higher active concentration.

The disadvantage of foaming however is the need to provide space for the foaming to take place, which requires either a larger container or a smaller unit volume of composition per container.

U.S. patent application Ser. No. 706,857 filed July 19, 1976 shows that a low delivery rate can be achieved without the necessity of providing a foam chamber or space within the aerosol container, if the volume proportion of gas to liquid in the blend dispensed from the container is within the range from about 10:1 to about 40:1, and preferably within the range from about 15:1 to about 30:1. This is a sufficient proportion of gas to liquid to form a foam, such as is formed and dispensed from the foam type aerosol containers of U.S. Pat. Nos. 3,970,219 and referred to above, and a very much higher proportion of gas to liquid than has previously been blended with the liquid for expulsion purposes in conventional aerosol containers, such as the vapor tap containers of the Presant U.S. Pat. No. 3,544,258, referred to above. At such high proportions of gas to liquid, the formation of foam is possible, and even probable, despite the small volume of the blending space provided, but foam formation, if it occurs, is so fleeting, having a life of at most a fraction of a second, that a foam cannot be detected by ordinary means, due to the small dimensions of the open spaces in which it may exist, i.e., the blending space and valve passages, and the shortness of the delivery time from blending of gas and liquid to expulsion. However, the proportion of gas to liquid in the blend that is expelled can be determined, and when the proportion is in excess of 10:1, the delivery rate of liquid from the aerosol container is very low, and thus, the objective of the invention is achieved. Whether or not a foam is formed is therefore of no significance, except as a possible theoretical explanation of the phenomenon.

Accordingly, Ser. No. 706,857 provides a process for dispensing a spray container a low proportion of liquid, with a high proportion of propellant in gaseous form, by blending gas and liquid within the aerosol container prior to expulsion at a ratio of gas:liquid within the range from about 10:1 to about 40:1, and preferably from about 15:1 to about 30:1, with the result that a blend containing this low proportion of liquid and high proportion of gas is expelled from the container, and the proportion of liquid composition expelled per unit time correspondingly reduced.

The aerosol container in accordance with Ser. No. 706,857 comprises, in combination, a pressurizable container having a valve movable between open and closed positions, a valve stem, and a delivery port; a valve stem orifice in the valve stem in flow connection at one end with a blending space and at the other end with an aerosol-conveying valve stem passage leading to the delivery port; the valve stem orifice having a diameter within the range from about 0.50 to about 0.65 mm; bias means for holding the valve in a closed position; means for manipulating the valve against the bias means to an open position or expulsion of aerosol composition via the valve stem orifice to the delivery port; wall means defining the blending space and separating the blending space from liquid aerosol composition and propellant within the container; at least one liquid tap orifice through the wall means, having a cross-sectional open area within the range from about 0.4 and 0.6 $mm^2$ for flow of liquid aerosol composition into the blending space; at least one vapor tap orifice through the wall means, having a cross-sectional open area within the range from about 0.4 to about 0.8 $mm^2$ for flow of propellant into the blending space; the ratio of liquid tap orifice to vapor tap orifice cross-sectional open area being within the range from about 0.5 to about 0.9; the open areas of the liquid tap orifice and vapor tap orifice being selected within the stated ranges to provide a volume ratio of propellant gas:liquid aerosol composition within the range from about 10:1 to about 40:1, thereby limiting the delivery rate of liquid aerosol composition from the container when the valve is opened.

The dimensions of such aerosol containers are particularly suited to the dispensing of antiperspirant compositions in which the astringent salt is in dispersed form, where orifices of smaller dimensions are readily susceptible to clogging. Smaller dimensions can be used with compositions in which the active components are in solution, such as deodorants and hair sprays. Volume ratio requirements will vary somewhat, depending on the aerosol composition. In general, the volume ratio of propellant gas:liquid aerosol composition within the range from about 8:1 to about 40:1 is applicable to any aerosol composition containing a flammable propellant. The flammability of the spray is greatly reduced when the container is actuated in its normal, vertical position. At a higher than about 40:1 ratio, the propellant is exhausted too rapidly, and an excessive amount of non-propellant compositions remains in the container.

The aerosol containers in accordance with Ser. No. 706,857 have provision for expelling these high ratios of gas:liquid when the container is actuated in a normal or partially tilted position. However, if the container is inclined or tipped enough, or inverted, so that the gas phase can pass through the liquid tap orifice, and the liquid phase can pass through the vapor tap orifice, the gas:liquid ratio expelled is less than about 8:1, and flammability is accordingly increased.

At some angle of tilt as the container is tipped from an upright towards a horizontal position, liquid phase can reach and pass through the gas tap orifice, and perhaps even both liquid tap and vapor tap orifices. This can result in an extremely flammable spray. Whether the latter condition actually occurs depends on the configuration of the container, the bend of the dip tube, and the liquid fill of the container.

Aerosol containers are commonly filled so that the liquid phase occupies 60% of the total capacity at 21° C. With this fill in a container with minimum doming, a straight dip tube, and a vapor tap orifice about 0.6 mm in diameter, off-center and positioned downward when the container is horizontal, both gas and liquid tap orifices will be covered by liquid when the container is positioned so that the valve is in the range of about −5° (below horizontal) to +5° (above horizontal). If the dip tube bends downward when the container is horizontal, the range in valve position in which both taps are covered by liquid may extend to about −30° (below the horizontal) to about +5° (above the horizontal). The extent or span of this range will depend on the dimensions of the container. The larger the ratio of diameter:-height, the wider the span of the range.

The problem also arises in the foam-type aerosol containers of U.S. Pat. No. 4,019,657. At any angle where the valve is below the horizontal, the foam chamber can fill with the liquid phase, and the gas phase under high pressure will project this liquid from the container, when the delivery valve is opened.

With the aerosol containers of U.S. Pat. No. 3,970,219, the problem of a flammable spray due to the presence of a flammable liquefied propellant does not exist. Since the propellant is expelled only in gaseous form, very little liquid propellant need be present, and it will not cover the bubbler in any position. A flammability problem will arise only in the event that the liquid in the foam chamber is flammable. Then, if the foam chamber is more than 50% full, at any angle between the horizontal to an inverted orientation, the liquid will be expelled without benefit of foaming, and the spray will be flammable.

This problem is not normally encountered if the aerosol composition contains a preponderance of the nonflammable fluorocarbon propellants, unless the composition contains a high proportion of alcohol, such as hair sprays, when actuated in the normal upright position. If, however, nonflammable fluorocarbons cannot be used, and it is necessary to employ flammable hydrocarbon propellants, at least in a proportion where the liquid phase is flammable, then aerosol containers equipped with conventional vapor tap valves will pose a considerable fire hazard even when used in the normal, upright position. This hazard is posed by the containers of U.S. Pat. Nos. 3,970,219 and of Ser. Nos. 670,913 and of 706,857 only when the delivery valves of such containers are actuated with the container in an abnormal position ranging between below the horizontal to fully inverted.

In accordance with the present invention, this difficulty is overcome by including in combination with the delivery valve an overriding shut-off valve which, although normally open when the container is upright, automatically closes off flow of liquid through the delivery valve from the container to the delivery port at some limiting angle at or below the horizontal as the top of the container is brought below the horizontal, towards the fully inverted position. The shut-off valve will normally have closed fully before the container is fully inverted. The angle to the horizontal at which the valve must close is of course the angle at which liquid can flow to the delivery port and escape as liquid from the container, without benefit of a high gas ratio. This can be within the range from 0° (i.e. horizontal) to −90°, and preferably is from −5° to −45°, below the horizontal.

In this type of container, it is generally not possible to dispense the liquid contents of the container by opening the delivery valve unless the container is so oriented that a sufficient ratio of gas is expelled with the liquid phase. The container must be held in a fully upright position, or at least in a position with the valve above the horizontal. Otherwise, the liquid phase cannot flow through the open delivery valve, because the shut-off valve is closed.

The aerosol container in accordance with the invention comprises, in combination, a pressurizable container having at least one storage compartment for an aerosol composition and a liquefied propellant in which compartment propellant can assume an orientation according to orientation of the container between a horizontal and an upright position, and a horizontal and inverted position; a delivery valve movable manually between open and closed positions, and including a valve stem and a delivery port; an aerosol-conveying passage in flow connection at one end with the storage compartment and at the other end with the delivery port, manipulation of the delivery valve opening and closing the passage to flow of aerosol composition and propellant from the storage compartment to the delivery port; and a shut-off valve responsive to orientation of the container to move automatically between positions opening and closing off flow of liquefied propellant to the delivery port, the shut-off valve moving into an open position in an orientation of the container between a horizontal and an upright position, and moving into a closed position in an orientation of the container between the horizontal and an inverted position.

A preferred embodiment of delivery valve is of the vapor tap type, comprising a valve movable manually between open and closed positions; a valve stem and a delivery port; a valve stem orifice in the valve stem, in flow connection at one end with a blending space, and at the other end with an aerosol-conveying valve stem passage leading to the delivery port; bias means for holding the delivery valve in a closed position; means for manipulating the valve against the bias means to an open position, for expulsion of aerosol composition via the valve stem orifice to the delivery port; wall means defining a blending space, and separating the blending space from liquid aerosol composition and propellant within the container; at least one liquid tap orifice through the wall means; at least one vapor tap orifice through the wall means; and a shut-off valve means movable between a closed position closing off the valve stem passage and an open position allowing aerosol composition to pass through the valve stem passage, the shut-off valve being in the open position at least when the container is fully upright, and being in the closed position at least when the container is fully inverted, and moving from the open to the closed position at an angle therebetween beyond the horizontal at which liquid propellant can flow to and through the vapor tap orifice and escape through the delivery port via the aerosol conveying valve stem passage when the delivery valve is in the open position.

In a preferred embodiment of this type of valve, where particulate solids are not present, the valve stem orifice has a diameter within the range from about 0.33 to about 0.65 mm, at least one liquid tap orifice having a cross-sectional open area within the range from about 0.2 to about 0.8 $mm^2$, and at least one vapor tap orifice having a cross-sectional open area within the range from about 0.2 to about 0.8 $mm^2$, the ratio of liquid tap orifice to vapor tap orifice cross-sectional open area being within the range from about 0.5 to about 2.5; the open areas of the liquid tap orifice and vapor tap orifice being selected within the stated ranges to provide a volume ratio of propellant gas:liquid aerosol composition within the range from about 8:1 to about 40:1, limiting the delivery rate of liquid aerosol composition from the container when the valve is open.

In a preferred embodiment of this type of valve, where particulate solids are present, the valve stem orifice has a diameter within the range from about 0.50 to about 0.65 mm, at least one liquid tap orifice having a cross-sectional open area within the range from about 0.4 to about 0.8 $mm^2$, and at least one vapor tap orifice having a cross-sectional open area within the range from about 0.3 to about 0.8 $mm^2$, the ratio of liquid tap orifice to vapor tap orifice cross-sectional open area being within the range from about 0.5 to about 2.3; the open areas of the liquid tap orifice and vapor tap orifice being selected within the stated ranges to provide a volume ratio of propellant gas:liquid aerosol composition within the range from about 8:1 to about 40:1, limiting the delivery rate of liquid aerosol composition from the container when the valve is open.

In the special case where the liquid tap orifice is a capillary dip tube, and particulate solids are not present, the cross-sectional open area thereof is within the range from about 0.2 to about 1.8 $mm^2$, for flow of liquid aerosol composition into the blending space, and at least one vapor tap orifice through the wall means has a cross-sectional open area within the range from about 0.2 to about 0.8 $mm^2$ for flow of propellant gas into the blending space; and the ratio of capillary dip tube to vapor tap orifice cross-sectional open area is within the range from about 1.0 to about 3.2.

In the special case where the liquid tap orifice is a capillary dip tube, where the solids are present, the cross-sectional open area thereof is within the range from about 0.6 to about 1.8 $mm^2$, for flow of liquid aerosol composition into the blending space, and at least one vapor tap orifice through the wall means has a cross-sectional open area within the range from about 0.3 to about 0.8 $mm^2$ for flow of propellant gas into the blending space; and the ratio of capillary dip tube to vapor tap orifice cross-sectional open area is within the range from about 1.0 to about 3.2.

The controlling orifices to achieve the desired proportion of gas and liquid in the blend dispensed from the container are the vapor tap orifice, the liquid tap orifice (or in the case of a capillary dip tube, the capillary dip tube), and the valve stem orifice. The open areas of these orifices and the ratio of liquid tap orifice to vapor tap orifice open area should be controlled within the stated ranges. However, these dimensions are in no way critical to the operation of the shut-off valve, which can be used advantageously with delivery valves having other dimensions.

The valve delivery system normally includes, in addition to the valve stem orifice, an actuator orifice at the end of the passage through the actuator of the valve. The valve delivery system from the blending chamber through the valve stem and actuator to the delivery port thus includes, in flow sequence towards the delivery end, the valve stem orifice, the valve stem passage, and the actuator orifice. The controlling orifice in this sequence is the valve stem orifice, and the actuator orifice will normally have a diameter the same as or greater than the valve stem orifice, but not necessarily.

In the unlikely event that the actuator orifice has an open area that is less than the valve stem orifice, then the actuator orifice becomes the controlling orifice, downstream of the blending chamber, and its diameter may in that event be within the range from about 0.33 to about 0.65 mm when solids are not present, and from about 0.45 to about 0.65 mm when solids are present.

The delivery valve is disposed in a valve housing, which may also include or is in flow connection with the wall means defining the blending space. The blending space is of limited volume, insufficient to constitute a foam chamber, and only as large as required for thorough blending of gas and liquid therein before reaching the valve. A valve member may be movably disposed in the blending space, for movement between open and closed positions, away from and towards a valve seat at the inner end of the valve stem passage, with which the blending space is in flow connection when the valve is open.

The blending space can be small in volume, and no larger than the volume needed for full movement of a valve member therein. It can also be a narrow passage, large enough at one end for the valve member, and merging indistinguishably with the dip tube or tail piece passage. Any conventional mixing chamber in a vapor tap valve assembly will serve.

The volume of the blending space does not usually exceed 1cc, and can be as small as 0.1cc, but it is preferably from 0.5 to 1cc.

The liquid tap orifice communicates the blending space directly or indirectly with a capillary dip tube or a standard dip tube. A standard or capillary dip tube normally extends into the liquid composition or phase in the aerosol container, and may reach to the bottom of the container. A tail piece may be provided (but is not essential) at the valve housing as a coupling for linking the dip tube to the blending space within the valve housing. The tail piece when present has a through passage in fluid flow connection with the liquid composition or phase in the container, via the dip tube, and this passage leads directly into the blending space. The liquid tap orifice in this embodiment is an orifice or constriction in the passage, at the blending space end, at the dip tube end, or intermediate the ends. The orifice can also be in direct communication with the dip tube, in the event the tail piece is omitted. When the dip tube communicates directly with the blending space, the liquid tap orifice can be at the blending space end opening of the dip tube.

In the special case when a capillary dip tube is used, no liquid tap orifice as such is required. The capillary dip tube serves as the liquid tap orifice. However, the size parameters for the capillary dip tube and vapor tap orifice in that event are different, because of the unique flow restriction of the capillary dip tube, as noted previously.

The vapor tap orifice is in fluid flow connection with the propellant or gas phase of the aerosol container, and admits gas into the blending space before the valve stem delivery passage. Normally, therefore, it is in the wall means defining the blending space, and above the liquid tap orifice, although this is not essential. The vapor tap orifice can be in a wall beside or above the valve member, but it is of course upstream of the valve seat.

The valve delivery system of an aerosol container downstream of the valve normally includes an actuator which operates a delivery valve movable between open and closed positions, with a valve stem and an aerosol composition-conveying valve passage therethrough, in flow connection with a delivery port. The narrowest orifice in this delivery system is within the range from about 0.5 to about 0.65 mm.

Mixing of the gas and liquid phase occurs in the blending space, before these pass to the valve, and the diameters of the vapor tap and liquid tap orifices as well as the valve passage with which they are in communication are selected within the stated ranges to provide, when particulate solids are not present, a gas:liquid volume ratio within the range from about 8:1 to about 40:1, and preferably from about 15:1 to about 30:1, and, when particulate solids are present, a gas:liquid volume ratio with the range from about 10:1 to about 40:1, and preferably from about 15:1 to about 30:1. It will be appreciated that for a given size of these openings, the gas:liquid ratio obtained from gas and liquid fed therethrough from the supply in the container will vary with the particular propellant or propellants and the composition of the liquid phase. The viscosity of the liquid is a factor in determining the proportion that can flow through the liquid tap orifice per unit time, when the valve is opened.

The orifice ranges given are applicable to all dispersion-type antiperspirant aerosol compositions. Other orifice ranges may be used with other types of aerosol compositions.

The invention is also applicable to aerosol containers which have at least two compartments, a first foam compartment and a second propellant gas compartment, communicated by at least one gas tap orifice, which is across the line of flow through the foam compartment to the valve delivery port from the propellant compartment. A liquid aerosol composition to be foamed and then expelled from the container is placed in another compartment of the container, in flow communication via a liquid tap orifice with the first foam compartment, so as to admit liquid aerosol composition into the first foam compartment across the line of propellant gas flow via the gas orifice or orifices to the valve. The liquid aerosol composition to be dispensed can be in the second compartment, dissolved or emulsified with liquid propellant or as a separate layer from the propellant layer, or in a third compartment, and the propellant is placed in the second or propellant compartment on the other side of the gas tap orifice or orifices. When the valve is opened, the propellant passes in gaseous form through the gas tap orifice(s) and foams the liquid aerosol composition in the foam compartment, at the same time propelling the foamed aerosol composition to and through the open valve passage out from the container.

The first or foam compartment between the gas tap and liquid tap orifices and the valve provides the space needed for foam formation, and has a volume of at least 0.5 cc and preferably from 1 to 4 cc, but larger compartments can be used. A practical upper limit based on the available aerosol container sizes is about 20 cc, but this can of course be exceeded since it is limited only by the size of the aerosol container. In general, the required volume of the first of foam compartment depends upon the rate at which product is delivered. Low delivery rates (less than about 0.2 g per second) require a capacity of about 0.5 to 1 cc. Medium delivery rates (about 0.2 to 0.5 g per second) require a capacity of about 1 to 2 cc. High delivery rates (about 0.5 to 2 g per second) require a capacity of about 2 to 4 cc. The first compartment may have a higher capacity, but it should preferably not have a smaller capacity; otherwise the space available may not be sufficient for foaming. These required volumes are illustrative and not limiting.

The length of the foam compartment, i.e. the distance from the nearest gas tap orifice(s) to the inlet end of the valve passage, is determined by the foam characteristics of the composition and whether it is desired to dispense a foam or a liquid or a mixture of the two. Consequently, the length of the foam compartment is not critical, but can be adjusted according to these requirements.

The overall dimensions of the gas tap and the liquid tap orifice(s) are selected according to the required product delivery rate (including propellant expelled) and whether a liquefied propellant or a compressed gas propellant is used. Where a compressed gas propellant is the only propellent present in the container, the quantity of propellant is quite limited and must be conserved by using only small gas tap orifices.

The following illustrates the orifice sizes that are used and is not intended to be limiting:

Using a compressed gas propellant to obtain a high product delivery rate, a 0.030 to 0.040 inch i.d. $>1$ cm long capillary dip tube could be used as a liquid tap orifice and a 0.003 to 0.004 inch i.d. short $<1$ cm orifice (as in a compartment wall) as the gas tap orifice.

Using a compressed gas propellant to obtain a low product delivery rate, a 0.014 to 0.020 inch i.d. $>1$ cm long capillary dip tube could be used as the liquid tap orifice and a 0.006 inch i.d. short $<1$ cm orifice as the gas tap orifice.

Using a liquefied propellant to obtain a high product delivery rate, a 0.060 to 0.080 inch i.d. $>1$ cm capillary dip tube could be used as the liquid tap orifice and a 0.010 to 0.013 inch i.d. $<1$ cm orifice as the gas tap orifice.

Using a liquefied propellant to obtain a low product delivery rate, a 0.030 inch i.d. $>1$ cm capillary dip tube could be used as the liquid tap orifice and a 0.018 inch i.d. $<1$ cm orifice as the gas tap orifice.

In general, a $<1$ cm orifice of about half the diameter can be substituted for the $>1$ cm capillary dip tube used as the liquid tap orifice. Conversely, a $>1$ cm capillary tube of about twice the diameter can be substituted for the $<1$ cm orifice used as the gas tap orifice.

The gas tap orifice (or orifices) should have (or total) a total cross-sectional open area within the range from about $7 \times 10^{-6}$ to about $20 \times 10^{-4}$ in$^2$ (a single orifice having an internal diameter within the range from about 0.003 inch to about 0.05 inch) and can be larger or smaller than the liquid tap orifice (or orifices).

The liquid tap orifice can be short (i.e. $<1$ cm) or long (i.e. $>1$ cm). A long orifice must have a larger diameter than a small one, because of liquid friction during the passage therethrough. Thus a capillary dip tube can have an internal diameter within the range from about 0.01 inch to about 0.08 inch (0.025 to 0.2 cm), while a short $<1$ cm orifice can have an internal diameter within the range from about 0.005 inch to about 0.04 inch (0.012 to 0.1 cm).

To provide sufficient foaming space, there is an important ratio of foam compartment volume to liquid tap orifice diameter that should be from about $10/x$, and preferably from about $20/x$, up to about $400/x$, preferably about $200/x$, where $x$ is a constant selected according to orifice length. For orifices less than 1 cm long, $x = 1$. For orifices 1 cm long or greater, $x = 2$.

Preferred dimensions depend upon whether a liquid or gaseous propellant is used, and are as follows:

| | Liquid Propellant | Gas Propellant |
|---|---|---|
| First Compartment volume (cc) | 0.5 to 4 | 1 to 4 |
| First Liquid Tap Orifice[1] inside diameter (cm) | 0.06 to 0.2 | 0.012 to 0.1 |
| Ratio of First Compartment Volume to First Liquid Tap Orifice Diameter | $\frac{10}{x}$ to $\frac{50}{x}$ | $\frac{20}{x}$ to $\frac{100}{x}$ |
| Second Gas Tap Orifice Cross-sectional area (in$^2$) | $2.5 \times 10^{-4}$ to $20 \times 10^{-4}$ | $7 \times 10^{-6}$ to $20 \times 10^{-6}$ |

[1]These dimensions are for a long orifice (capillary dip tube). If the orifice is short, less than 1 cm, diameters are reduced by 1/2.
[2]Values shown are for a short orifice, less than 1 cm.

Both the gas tap and liquid tap orifices are in the means defining the foam compartment, such as a wall thereof. The liquid tap orifice is placed so that liquid aerosol composition entering the foam compartment is disposed across the line of flow from the gas tap orifice to the valve and out from the container. The liquid tap orifice can be below, above, or on a line with the gas tap orifice.

The gas tap orifice(s) should be located out of direct contact with propellant liquid to ensure that the propellant gas, whether liquefied or not, enters as gas bubbles into the liquid aerosol composition to form a foam. The type of foam that is formed depends upon a number of variables, of which the most important are the foaming qualities of the liquid aerosol composition; the diameter of the gas tap orifice(s) which determines the size of the gas bubbles released therefrom into the liquid aerosol composition; the height or depth of the layer of aerosol composition through which the bubbles must pass in order to reach the valve for expulsion from the container; the distance between the layer of aerosol composition and the valve; and the rate of formation, i.e., rate of bubbling, and relative stability of the foam, which can be controlled by pressure of propellant gas; the number of gas tap orifices; and foaming agents present in the liquid aerosol composition.

The gas tap and liquid tap orifices can be disposed in any type of porous or foraminous structure. One each of a gas tap and liquid tap orifice through the compartment wall separating the propellant and any other compartments from the foam compartment will suffice. A plurality of gas tap and liquid tap orifices can be used, for more rapid foaming and composition delivery. The total orifice open area is of course determinative, so that several large orifices can afford a similar delivery rate to many small orifices. However, gas tap orifice size also affects bubble size, as noted above, so that if small bubbles are desired a plurality of small gas tap orifices may be preferable to several large orifices.

Orifices may also be provided on a member inserted in the wall or at one end of the wall separating the propellant and any other compartments from the foam compartment. One type of such member is a perforated or apertured plastic or metal plate or sheet.

The liquid tap orifice can be rather short or rather long, as in a capillary dip tube extending into the bottom of a layer or compartment for liquid aerosol composition. The term "orifice" generically encompasses capillary passages, which behave as orifices regardless of length in respect to liquid aerosol composition flow therethrough.

The cross-sectional shape of the orifice is not critical. The orifices can be circular, elliptical, rectangular, polygonal, or any other irregular or regular shape in cross-section.

Large orifices form large bubbles, and expel a relatively high ratio of propellant to liquid, and these are less efficient utilizers of propellant. Very small orifices may offer high resistance to gas flow, unless they are relatively short, i.e., the material is thin, as in the case of membrane filters. Since thin materials are relatively weak, supporting structures may be required, which increase the cost of the container. The preferred orifices are through the separating compartment wall.

The gas tap and liquid tap orifices should provide an open area sufficient to provide a propellant gas flow to foam a sufficient volume of liquid aerosol composition for a given delivery of foam spray. Thus, the open area is determined by the amount of aerosol composition to be foamed, and the amount of the delivery. In general, the orifice open area is not critical, and can be widely varied. However, it is usually preferred that the open area be within the range from about 0.005 to about 10 $mm^2$, and still more preferably from about 0.01 to about 1 $mm^2$.

The shut-off valve of the invention can be placed at any convenient location across the line of flow of liquid to the delivery port. Thus, it can be at or in the passage leading directly to the delivery port, downstream or upstream of the delivery valve, in the blending space, or in a foam chamber, if there be one, or at or in the vapor tap orifice.

It is sufficient to close off the vapor tap orifice, if there be a dip tube leading to the liquid tap orifice, since this will prevent escape of liquid. However, the shut-off valve can also be arranged to close off the valve stem orifice, or the blending space of foam chamber, or the valve stem passage. In all such cases, all flow is cut off, even if the manipulatable valve be open.

The shut-off valve in accordance with the invention can take any of several forms.

A preferred embodiment of shut-off valve has a valve means which is free to roll with gravity, such as a cylinder or ball, which can roll freely along an inclined guide, chute or support, into a position at the valve seat closing off the valve passage when the container is in any position between a few degrees less than horizontal to fully inverted, i.e., from $-2°$ to $-90°$ below the horizontal, but which normally is drawn by gravity into an at-rest position in which the shut-off valve is open when the top of the container is in any position between a few degrees below the horizontal to fully upright, i.e., $+90°$. As the container is brought from an upright position toward the horizontal, the ball or cylinder can roll down towards the valve seat, and at some angle near the horizontal will roll into position on the valve seat, closing off flow to the valve passage. The flammability hazard is eliminated when the container is in any position.

This embodiment is especially suitable for disposition in a blending space, or foam chamber, or across a delivery valve stem passage or orifice, including a vapor tap valve in the ball housing.

Another embodiment of the shut-off valve of the invention is a slide valve, slidable along a guide between open and closed positions. In the open position, the slide valve is away from the valve seat and the valve passage is open. As the container is brought into a fully inverted position at an angle at about 10° or so beyond the horizontal, the slide valve slides along the guide into contact with the valve seat, closing off the valve passage.

The slide valve can for example be tubular and arranged to slide along a concentric tubular guide, the guide constituting a dip tube, or a wall enclosing a blending space or foam chamber. The vapor tap or valve stem orifice extends radially through the tubular guide, or is disposed axially at one end of the tubular guide. In the former case, the side of the tubular slide valve can be arranged to close off the orifice through the tubular guide. In the latter case, the end of the slide valve can be arranged to close off the orifice, when brought into abutting relation therewith.

Another form of slide valve has a disc with a flanged outer periphery, movable along the concentric tubular guide. The orifice or passage to be closed off is axially disposed, in a wall of a mixing or blending space or foam chamber. It can for example be a vapor tap orifice through the bottom wall of the blending space or foam chamber. The vapor tap orifice is accordingly closed off when the disc comes into abutment with the bottom wall, guided in this position by the tubular guide.

Other variations will be apparent to those skilled in this art.

Preferred embodiments of aerosol containers in accordance with the invention are illustrated in the drawings, in which:

FIG. 3 represents a fragmentary longitudinal sectional view of another embodiment of valve system in accordance with the invention, with a restricted tail piece and a standard dip tube in fluid flow connection with the vapor tap orifice; and the shut-off valve arranged as a slide valve to move along the projecting wall of the blending space as a tubular guide.

FIG. 4 represents a cross-sectional view taken along the line 4—4 of FIG. 3;

Figure 9:
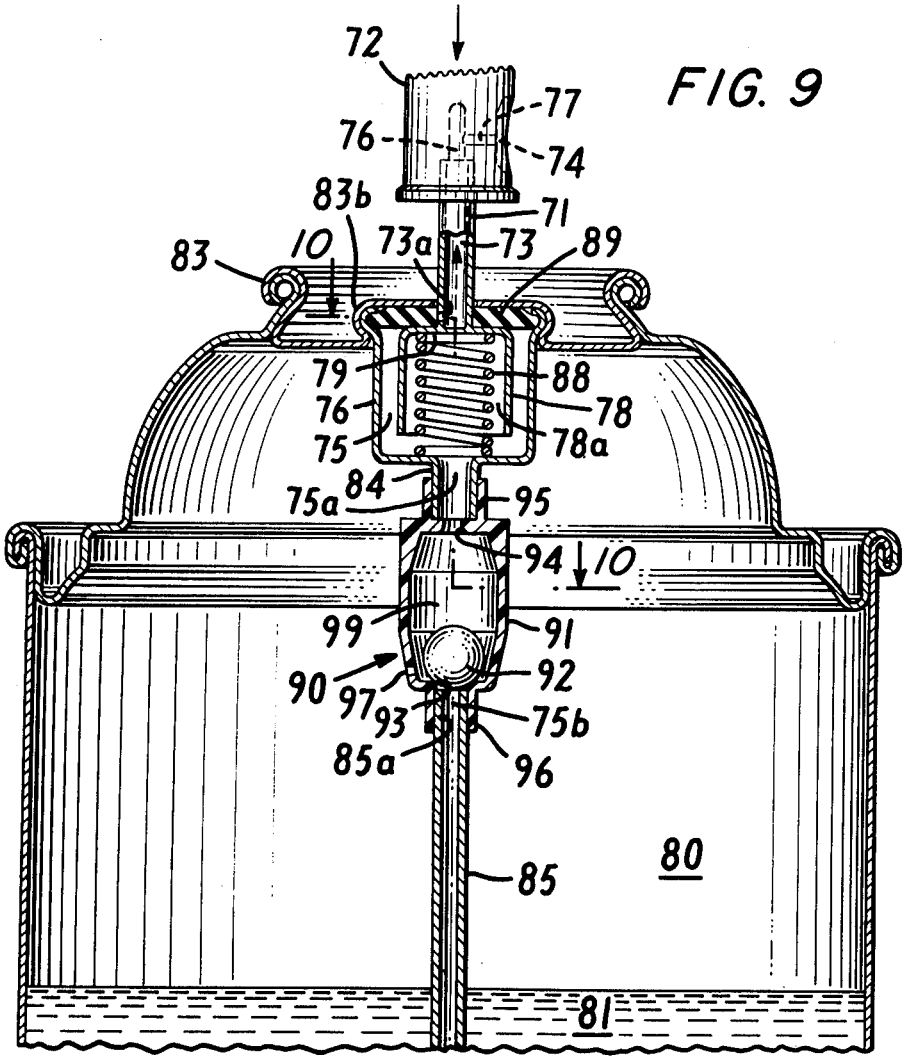
FIG. 9 represents a fragmentary longitudinal sectional view of another embodiment of valve system, with the aerosol container in the upright position, with a capillary dip tube, and with the shut-off valve arranged as a ball valve, in the open position, movable within an enlarged portion of the dip tube.
Figure 9A:
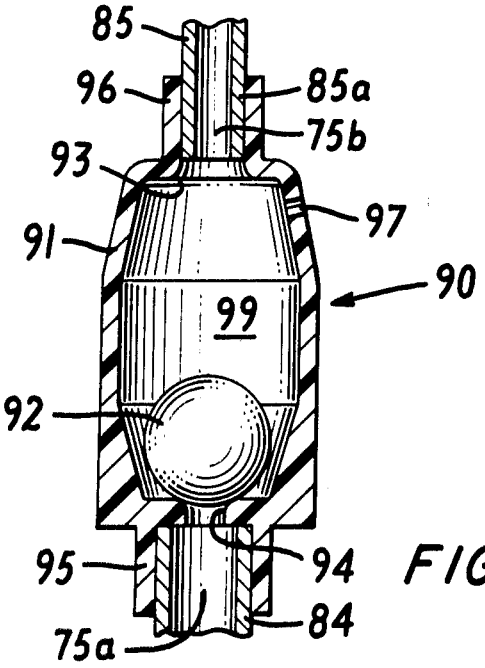
Figure 10:
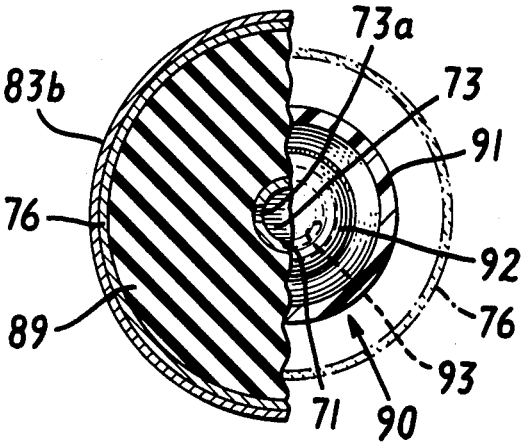

FIG. 9A repesents a detailed view showing the shut-off valve of FIG. 9 in the closed position, with the container inverted;

FIG. 10 represents a cross-sectional view taken along line 10—10 of FIG. 9.

Figure 11:
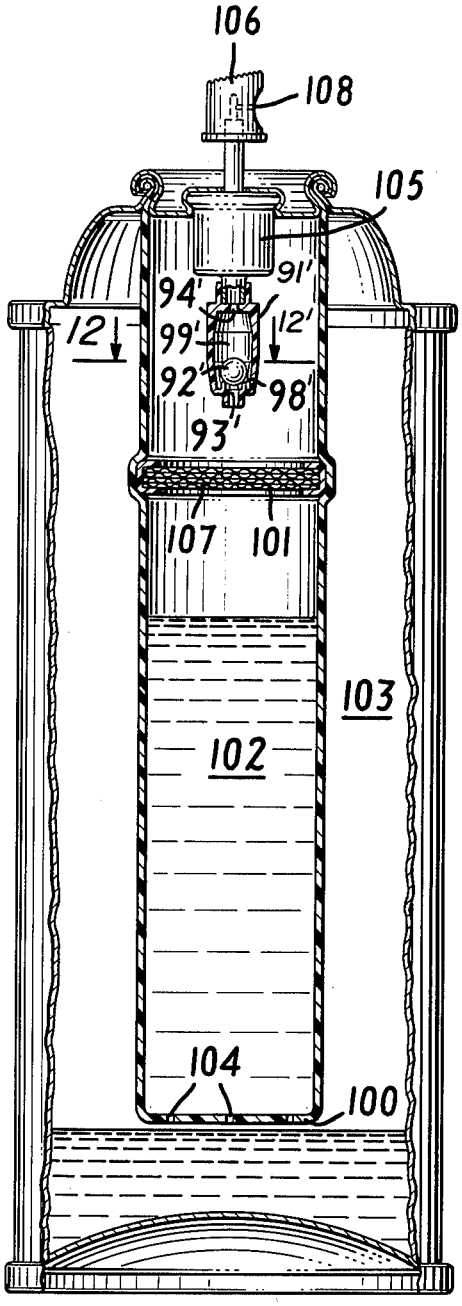
Figure 11A:
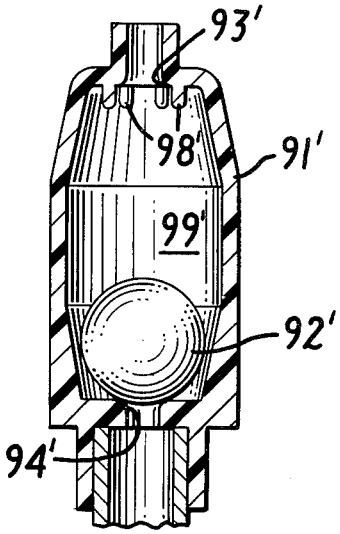
Figure 12:
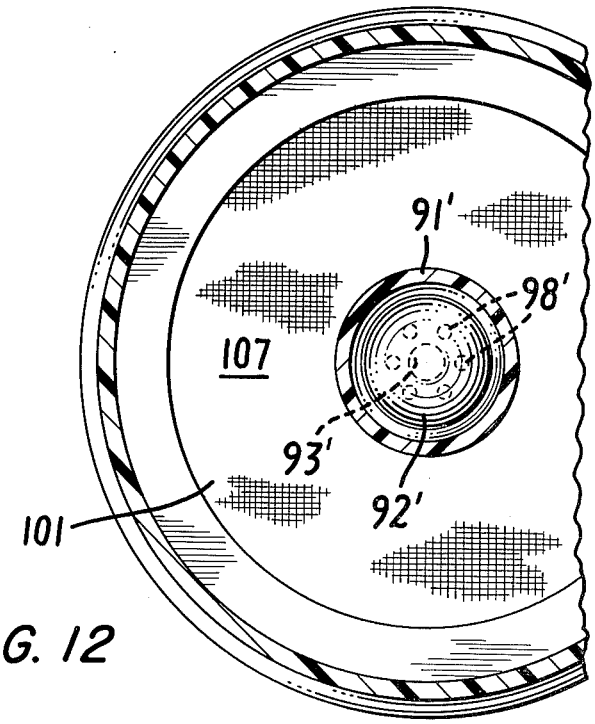

FIG. 11 represents a longitudinal sectional view of another embodiment of aerosol container in the open position, with a pair of porous bubblers and a shut-off valve of the ball type in the open position, at the inlet end of the delivery valve stem passage; and FIG. 11A represents a detailed view showing the shut-off valve of FIG. 11 in the closed position, with the container inverted; and FIG. 12 represents a cross-sectional view taken along the line 12—12 of FIG. 11.

In principle, the preferred aerosol containers of the invention utilize a container having at least one compartment for propellant gas and liquid aerosol composition, communicated by at least one gas tap orifice and at least one liquid tap orifice to a blending space, which is across the line of flow to the valve delivery port. A liquid aerosol composition to be blended with propellant gas and then expelled from the container is placed in this compartment of the container, in flow communication via the liquid tap orifice with the blending space, so as to admit liquid aerosol composition into the blending space, while propellant gas flows into the blending space via the gas tap orifice or orifices to the valve.

The aerosol containers in accordance with the invention can be made of metal or plastic, the latter being preferred for corrosion resistance. However, plastic-coated metal containers can also be used, to reduce corrosion. Aluminum, anodized aluminum, coated aluminum, zinc-plated and cadmium-plated steel, tin, and acetal polymers such as Celcon or Delrin are suitable container materials.

The gas tap and liquid tap orifices can be disposed in any type of porous or foraminous structure. One each of a gas tap and liquid tap orifice through the compartment wall separating the propellant and any other compartments from the blending space will suffice. A plurality of gas tap and liquid tap orifices can be used, for more rapid blending and composition delivery, but the delivery rate of liquid will still be low, because of the high gas:liquid ratio. The total orifice open area is of course determinative, so that several large orifices can afford a similar delivery rate to many small orifices. However, gas tap orifice size also affects blending, so that a plurality of small gas tap orifices may be preferable to several large orifices.

Orifices may also be provided on a member inserted in the wall or at one end of the wall separating the propellant and any other compartments from the blending space. One type of such member is a perforated or apertured plastic or metal plate or sheet.

The liquid tap orifice can be rather short or rather long, as in a passage through a tail piece member. While a capillary dip tube extending into the bottom of a layer or compartment for liquid aerosol composition is a kind of liquid tap orifice, different dimensions are applicable. The term "orifice" as used herein generically encompasses passages narrow enough to behave as orifices, regardless of length, in respect to liquid aerosol composition flowed therethrough.

The cross-sectional shape of the orifice is not critical. The orifices can be circular, elliptical, rectangular, polygonal, or any other irregular or regular shape in cross-section.

Figure 1:
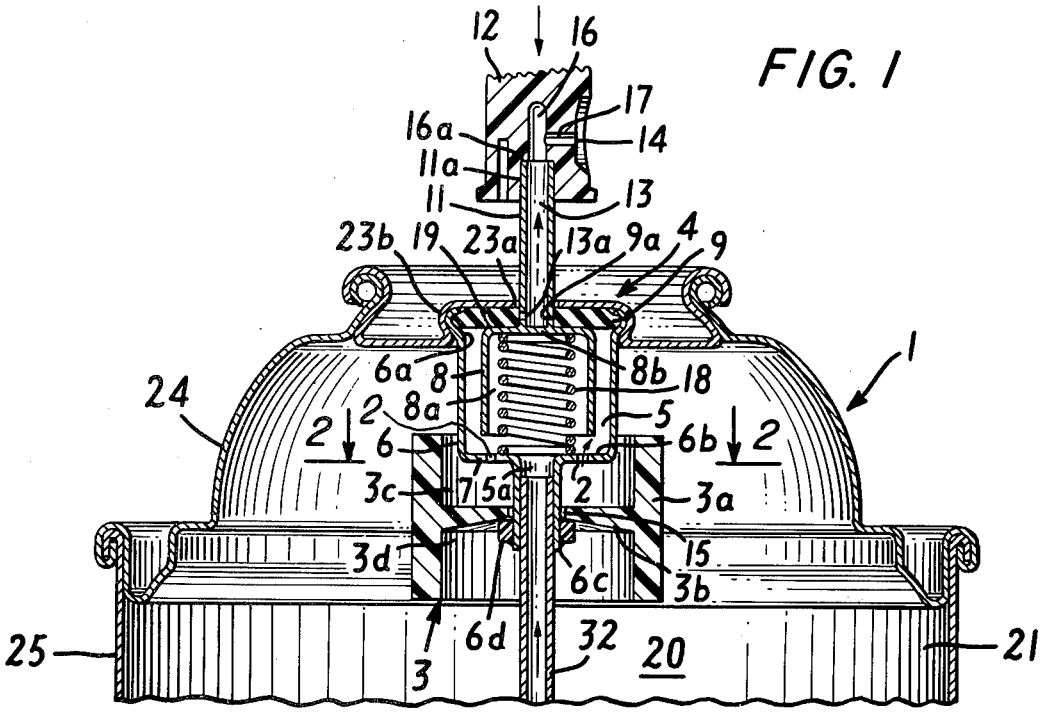
FIG. 1 represents a fragmentary longitudinal sectional view of the valve system of one embodiment of aerosol container in accordance with the invention, including a capillary dip tube in fluid flow connection with the vapor tap orifice; with the shut-off valve arranged as a slide view movable along the dip tube as a tubular guide; and shown in the open position.
Figure 1A:
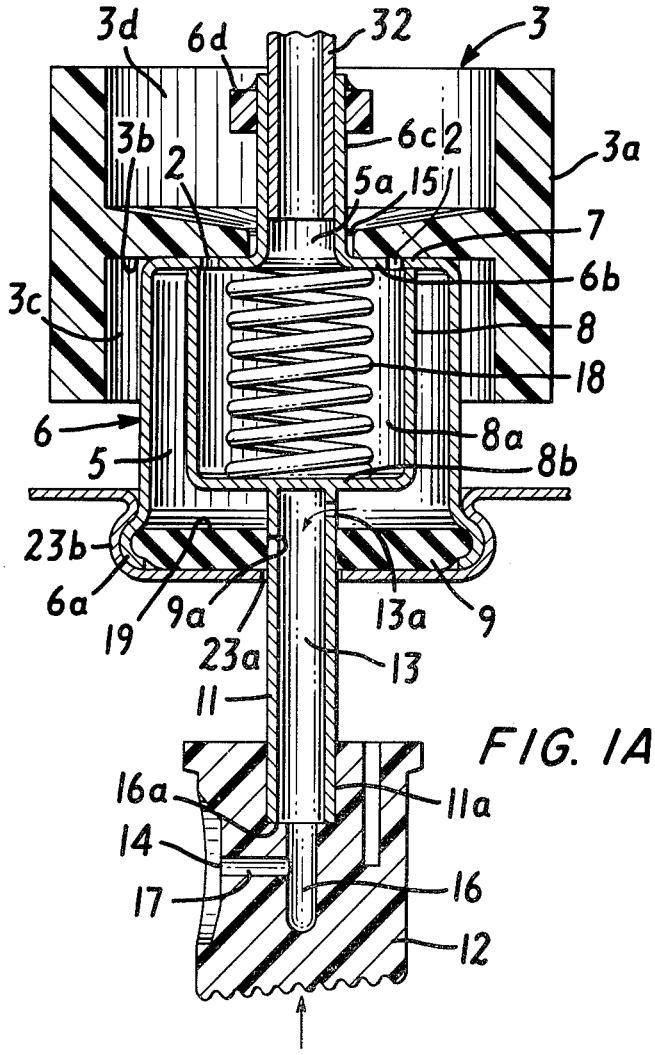
FIG. 1A represents a detailed view of the valve stem and poppet, inverted, and showing the shut-off valve in the closed position.
Figure 2:
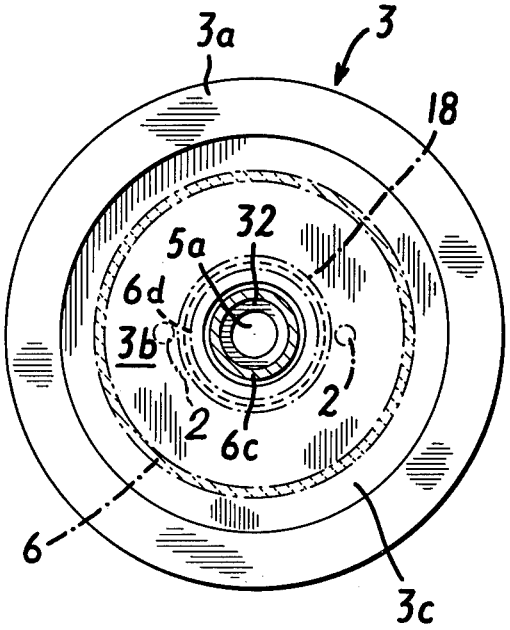
FIG. 2 represents a cross-sectional view taken along the line 2—2 of FIG. 1.

In the aerosol container 1 shown in FIGS. 1, 1A and 2, the aerosol valve 4 is of conventional type, and comprises a delivery valve poppet 8 seating against the sealing face 19 of a sealing gasket 9 and integral with a valve stem 11. The delivery valve poppet 8 is open at the inner end, defining a socket **8*a* therein, for the reception of a coil spring 18. The passage 13 is separated from the socket 8*a* within the poppet 8 by the divider wall 8*b***.

Adjacent the poppet wall **8*b* in a side wall of the stem 11 is a valve stem orifice 13*a*. The gasket 9 has a central opening 9*a* therethrough, which receives the valve stem 11 in a sliding leak-tight fit, permitting the stem to move easily in either direction through the opening, without leakage of propellant gas or liquid from the container. When the valve stem is in the outwardly extending position shown in FIG. 1, the surface of the poppet portion 8 contiguous with wall 8*b* is in sealing engagement with the inner face of the gasket 9, closing off the orifice 13***a* and the passage 13 to outward flow of the contents of the container.

The outer end portion 11*a* of the valve stem 11 is received in the axial socket 16 of the button actuator 12, the tip engaging the ledge 16*a* of the recess. The stem is attached to the actuator by a press fit. The axial socket 16 is in flow communication with a lateral passage 17, leading to the actuator (valve delivery) orifice 14 of the button 12.

The compression coil spring 18 has one end retained in the socket 8*a* of the valve poppet 8, and is based at its other end upon inner wall 6*b* of the valve housing 6. The spring 18 biases the poppet 8 towards the gasket 9, engaging it in a leak-tight seal at the valve seat 19. When the valve poppet is against the valve seat 19, the orifice 13*a* leading into the passage 13 of the valve stem is closed off.

The delivery valve is however reciprocably movable towards and away from the valve seat 19 by pressing inwardly on the button actuator 12, thus moving the valve stem 11 and with it poppet 8 against the spring 18. When the valve is moved far enough away from the seat 19, into the position shown in detail in FIG. 1A, the orifice 13*a* is brought beneath the valve gasket 9, and a flow passage is therefore open from the blending space 5 defined by the valve housing 6 to the delivery port 14. The limiting open position of the valve poppet 8 is fixed by the wall 6*b* of housing 6, the valve poppet 8 encountering the housing wall, and stopped. The valve stem orifice 13*a* when in the open position communicates the stem passage 13 with the actuator passages 16, 17 and valve delivery orifice 14, and thus depressing the actuator 12 permits fluid flow via the space 5 to be dispensed from the container at delivery port 14.

Thus, the spring 18 ensures that the valve poppet 8 and therefore valve 4 is normally in a closed position, and that the valve is open only when the button actuator 12 is moved manually against the force of the spring 18.

The valve housing 6 has an expanded portion 6*a* within which is received the sealing gasket 9 and retained in position at the upper end of the housing. The expanded portion 6*a* is retained by the crimp 23*b* in the center of the mounting cup 23, with the valve stem 11 extending through an aperture 23*a* in the cup. The cup 23 is attached to the container dome 24, which in turn is attached to the main container portion 25.

Through the bottom wall 7 of the valve housing 6 are two vapor tap orifices 2, which are in flow connection with the upper portion 20 of the space 21 within the container 1, and therefore with the gas phase of propellant, which rises into this portion of the container. The blending space 5 of the valve housing 6 terminates in a passage 5*a*, enclosed in the projection 6*c* of the housing 6. In the passage 5*a* is inserted one end of the capillary dip tube 32, which extends all the way to the bottom of the container, and thus dips into the liquid phase of the aerosol composition in portion 21 of the container. Liquid aerosol composition accordingly enters the space 5 at the passage 5*a*, via the capillary dip tube 32, so that the dip tube serves as a long liquid tap orifice, while gas enters the space 5 through the gas tap orifices 2.

In the valve shown, the diameter of the actuator (valve delivery) orifice 14 is 0.5 mm, the valve stem orifice 13*a* is 0.5 mm, the diameter of the vapor tap orifices 2 is 0.76 mm and the inside diameter of the capillary dip tube 32 is 1.0 mm.

In operation, button 12 is depressed, so that the valve stem 11 and with it valve poppet 8 and orifice 13*a* are manipulated to the open position, away from valve seat 19. Liquid aerosol composition is thereupon drawn up via the capillary dip tube 32 and passage 5*a* into the blending space 5, where it flows up around the poppet 8 towards the valve stem orifice 13*a*, while propellant gas passes through the vapor tap orifices 2, and is blended with the liquid aerosol composition in the space 5 entering from dip tube 32, as it flows around the poppet 8. The dimensions of the orifices 2, 32 are such that 18 volumes of gas enter through the vapor tap orifices 2 for each volume of liquid entering from the capillary dip tube 32.

The slide valve 3 of the invention has a valve body of plastic, for example polyethylene or polypropylene, with an annular rim 3*a* and a central disc valve 3*b*. The rim defines twin recesses 3*c* and 3*d*, of which recess 3*c* is wide enough and deep enough to receive the end 6*b* of the valve housing 6, and all of wall 7. When it does so, the disc valve 3*b* eventually abuts and covers over the bottom wall 7 of the valve housing 6, thus effectively closing off the vapor tap orifices 2, when the valve 3 is in the uppermost position. Accordingly, the valve in this position closes off the vapor tap orifices 2.

The disc valve 3*b* has a central aperture 15 through which passes loosely the projection 6*c* of the valve housing 6. The loose fit prevents binding of the disc against the projection 6*c*. The annular rim 3*a* is long enough to engage the housing 6 over the entire travel of the valve along projection 6*c* between the closed position abutting the bottom wall 7 of the housing 6, and the stops 6*d* on the projection 6*c*. In the open position, the valve disc 3*b* is in the lowermost position, and rests against the stop 6*d*, as shown in FIG. 1. In this position, the container is upright and the valve under the force of gravity remains in this position.

It will be apparent, however, that when the container is inverted, the valve will tend to slide along the projection 6*c* into the newly lowermost position (corresponding to the closed position) shown in FIG. 1A, with the valve disc 3*b* closing off the vapor tap orifices 2. This effectively prevents liquid from escaping from the container via the vapor tap orifices, even though the liquid is now on the other side of the container. The dip tube 32 now taps the gas phase, and thus it is quite impossible for liquid to escape from the container. Accordingly, a flammability hazard due to the escape of flammable liquid is avoided.

This container is capable of delivering a dispersion type aerosol antiperspirant composition of conventional formulation at a delivery rate of about 0.4 g/second, about 40% of the normal delivery rate of 1 g/second. Accordingly, in order to obtain the same delivery of active ingredients (such as active antiperspirant) per squirt of a unit time, it is necessary to considerably increase the concentration of active antiperspirant composition. Normally, such compositions contain less than 5% active antiperspirant, because of clogging problems using standardized aerosol container valve systems and dimensions. In this container, however, it is possible to deliver at a low delivery rate about 0.3 to about 0.7 g/second of aerosol antiperspirant composition containing from about 8% to about 20% active ingredient as suspended or dispersed solid material without clogging, because of the high proportion of gas to liquid.

In the aerosol container shown in FIGS. 3 and 4, the capillary dip tube is replaced by a dip tube of normal dimensions and a restricted tail piece is interposed between the valve and the dip tube to obtain the desired restriction of liquid composition flow towards the valve delivery system of the container when the valve is opened. In other respects, the container and the shut-off valve are identical to that of FIGS. 1, 1A and 2, and therefore like reference numerals are used for like parts.

In this container, the aerosol valve is of conventional type, as shown in FIGS. 3 and 4, with a valve stem 11 having a valve button 12 attached at one end, with valve button passages 16, 17 and a delivery orifice 14 therethrough, and a valve body 6 pinched by crimp 23*b* in the aerosol container cap 23. The valve body 6 has a blending space 5, which opens at the lower end into the restricted tail piece orifice 5*b*, constituting a liquid tap orifice, and at the other end, beyond the valve poppet 8, when the valve is open, into the valve stem orifice 13*a*. The valve poppet 8 is reciprocably mounted at one end of the valve stem 11, and is biased by the spring 18 against the valve seat 19 on the inside face of gasket 9 in the normally closed position. The valve is opened by depressing the button actuator 12. When the valve poppet 8 is away from its seat, the valve stem orifice 13*a* is in fluid flow communication with the blending space 5.

The valve housing 6 at its lower portion 6*g* is tapered, and is provided with a vapor tap orifice 2*a*, which puts the blending space 5 in flow connection with the gas or propellant phase in the space 20 at the upper portion of the aerosol container. The liquid aerosol composition is stored in the lower portion 21 of the container; and the dip tube 33 extends from the tail piece 6*f*, over which it is press-fitted in place, to the bottom of the container through the liquid phase, in flow connection with tail piece orifice 5*b*.

In this aerosol container, the diameter of actuator (valve delivery) orifice 14 is 0.5 mm; the diameter of the valve stem orifice 13*a* is 0.64 mm; the diameter of the vapor tap orifice 2*a* is 0.64 mm; and the diameter of the tail piece passage 5*b* is 0.76 mm.

In operation, the button 12 is depressed, so that the valve poppet 8 and orifice 13*a* are manipulated to the open position. Liquid aerosol composition is drawn up by the dip tube 33 via the restricted tail piece orifice passage 5*b* into the blending space 5, where it is blended with propellant gas entering the space via the vapor tap orifice 2*a* from the propellant space 21 of the container. The blend, in a volume ratio gas:liquid of at least 8, is expelled under propellant gas pressure through the valve stem orifice 13*a*, leaving the container via the stem passage 13, button passages 16, 17, and orifice 14 of the valve, as a fine spray.

The slide valve 3 has a valve body of plastic for example polyethylene or polypropylene, with an annular rim 3*a* and a central disc valve 3*b*. The rim defines a recess 3*d* which is wide enough and tapered to conform to the tapered end 6*g* of the valve housing 6. When it receives end 6*g*, the disc valve 3*b* covers over and abuts the bottom wall 7*a* of the valve housing 6, thus effectively closing off the vapor tap orifice 2*a*, when the valve 3 is in the uppermost position. Accordingly, the valve in this position closes off the vapor tap orifice 2*a*.

The disc valve 3*b* has a central aperture 15 which fits loosely over the tail piece 6*f* of the valve housing 6. The loose fit prevents binding of the disc against the tail piece 6*f*. The annular rim 3*a* is long enough to engage housing 6*g* over the free travel distance of the valve 3 between the closed position, abutting the bottom wall 7*a* of the housing 6, and the stop 6*d* on the tail piece 6*f*. In the open position, the valve disc 3*b* rests against the stop 6*d*, as shown in FIG. 3. In this position, the container is upright, and the valve under the force of gravity remains in the lowermost position.

It will be apparent however that when the container is inverted, the valve 3 will tend to slide along the tail piece 6*f*, into the newly lowermost position corresponding to the closed position, with the valve disc 3*b* closing off the vapor tap orifice 2*a*. This effectively prevents liquid from escaping from the container via the vapor tap orifice, even though the liquid is now on the other side of the container. The dip tube 33 now taps the gas phase, and thus it is quite impossible for liquid propellant to escape from the container. Accordingly, a flammability hazard due to the escape of flammable liquid is avoided.

Figure 5:
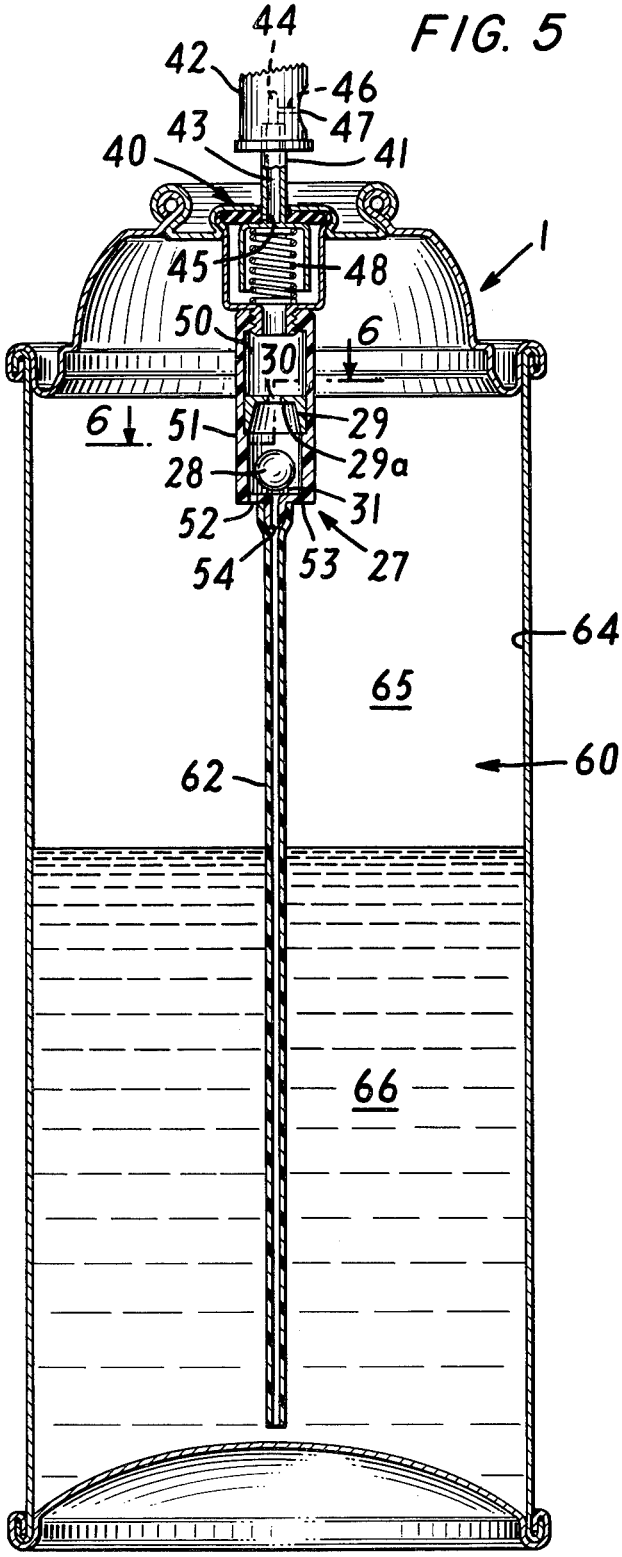
FIG. 5 represents a longitudinal sectional view of another embodiment of aerosol container in accordance with the invention, in the upright position, with a foam chamber, and a ball valve in the open position, movable within the foam chamber between open and closed positions.
Figure 6:
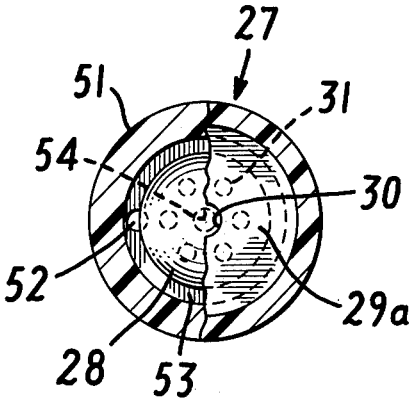
FIG. 6 represents a cross-sectional view taken along the line 6—6 of FIG. 5.

In the aerosol container shown in FIGS. 5 and 6, the aerosol delivery valve 40 is of conventional type, with a valve stem 41 having a valve button 42 attached at one end and a flow passage 43 therethrough, in flow communication at one end via port 45 with the interior of a first foam compartment 50 of the container 1, defined by side walls 51, with a gas tap orifice 52 therein, and an orifice plate bottom 53 with a liquid tap orifice 54 therein. The orifice 52 is 1.0 mm in diameter, and orifice 54 is 1.0 mm in diameter. Both orifices 52, 54 are in flow communication with a second compartment 60, defined by side wall 51 and the outer container wall 64. The valve passage 43 is open at the other end at port 44 via button passage 46 to delivery port 47. The valve button 42 is manually moved againt the coil spring 48 between open and closed positions. In the closed position, shown in FIG. 5, the valve port 45 is closed, the valve being seated against the valve seat. In the open position, the valve stem is depressed by pushing in button 42, so that port 45 is exposed, and the contents of the foam compartment are free to pass through the valve passage 43 and button passage 46 out the delivery port 47.

The remainder of the interior of the aerosol container outside the walls 51 and bottom 53 of the foam compartment 50 thus constitutes the second annular propellant compartment 60 surrounding the first. The second compartment 60 contains liquefied propellant (such as a flammable hydrocarbon, with a gas layer above, that fills headspace 65) as part of the liquid layer 66 of aerosol composition. A dip tube 62 extends from the orifice 53 in foam compartment 50 to the bottom of the propellant compartment 60. Through it, liquid aerosol composition enters the foam compartment at orifice 54, when the valve 40 is opened, and forms a layer therein.

In operation, button 42 is depressed, so that the delivery valve is manipulated to the open position. Liquid aerosol composition is drawn up via dip tube 62 and orifice 54 into foam compartment 50, while propellant gas passes through the orifice 52 and bubbles into aerosol composition in the compartment 50, where it foams the aerosol composition, and then expels the foamed aerosol composition through the passages 43, 46 leaving the container via port 47 of the valve as a fine spray.

In this embodiment, aerosol composition and propellant gas are simultaneously introduced into the foam compartment 50 when the button 42 is depressed. The characteristics of the spray that is dispensed depends on the relative rates at which these components are introduced into the foam compartment. Thus, if the proportion of propellant gas to liquid aerosol composition is relatively high, the spray will be moist rather than wet, and the delivery rate will be low. If the proportion of propellant gas to liquid aerosol composition is relatively low, the spray will be wet, and the delivery rate will be relatively high.

The shut-off valve 27 in accordance with the invention comprises a ball 28 of inert noncorrodible metal such as aluminum, stainless steel, or brass, which is free to roll within the lower portion of the foam chamber 50 defined by the valve seat 29 and the bottom wall 53 of the chamber. The valve seat is defined by the annular projection 29*a* extending inwardly from the wall 51 of the foam chamber 50, with a central orifice 30. The lower wall of the valve seat 29 is tapered upwardly towards the orifice 30 sufficiently to guide the ball 28 and permit it to lodge in the orifice 30, closing it off. Extending upwardly from the bottom wall 53 of the foam chamber 50 are a series of projections 31 (which can be omitted, if desired), which when the ball is in the position shown at the bottom of the chamber 50, retain the ball away from the liquid tap orifice 54, communicating with the dip tube 62.

In the normal upright position of the container, as shown in FIG. 5, the ball 28 is at the bottom of the foam chamber, resting on the projections 31. Accordingly, when the button 42 is depressed, the valve 40 is opened, and liquid aerosol composition can be drawn up through the dip tube 62 into the foam chamber 50, while vapor phase propellant gas from the head space 65 can enter the foam chamber through the vapor tap orifice 52. Thus, the container acts normally when it is in this position, and in fact in all positions above the horizontal, since the ball then tends under gravity to remain in the position shown.

Figure 5A:
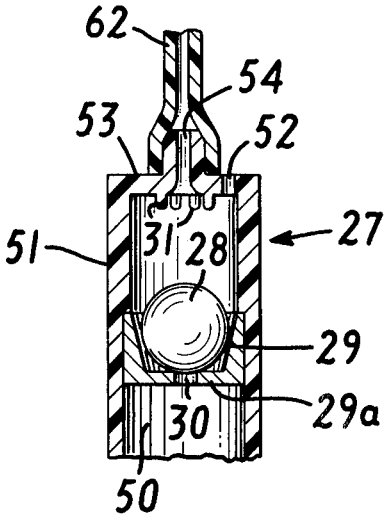
FIG. 5A is a detailed view showing the shut-off valve of FIG. 5 in the closed position, with the container inverted.

When however the container is inverted so the delivery valve 40 is below the horizontal, the ball is free to roll along the side walls of the foam chamber 50, and when it does so, it moves against the orifice 30, closing it off, as seen in FIG. 5A. It is guided there by the tapered walls of the valve seat 29. It is held in this position by the pressure of liquid in that portion of the foam chamber from the dip tube 62, and also by pressure of liquid propellant through the vapor tap orifice 52. In this position, the ball closes off delivery valve 40 and the foam chamber beyond the valve 27 from the compartment 60 and the contents thereof, so that delivery of aerosol composition is effectively stopped. This prevents the escape of liquid propellant through the vapor tap orifice 52 and the valve stem passage delivery port 45, thus avoiding a flammability hazard.

Figure 7:
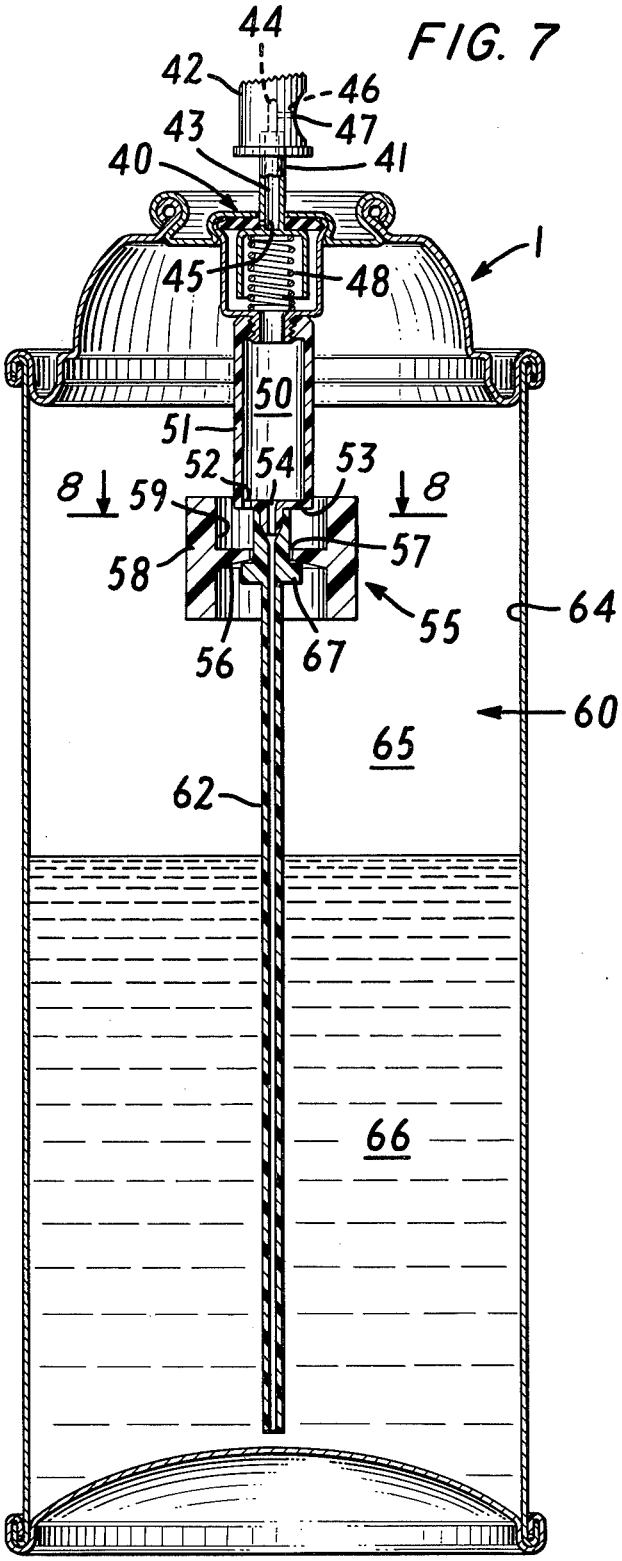
FIG. 7 represents a longitudinal sectional view of another embodiment of aerosol container in accordance with the invention, in the upright position, with a foam chamber, and a slidable disc valve in the open position, arranged to close off a vapor tap orifice in the bottom wall of the foam chamber when the container is inverted.
Figure 7A:
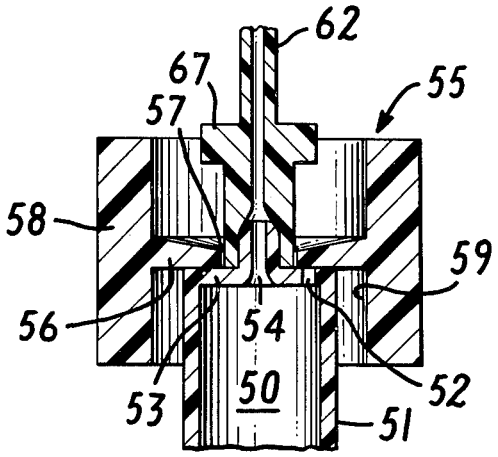
FIG. 7A is a detailed view showing the shut-off valve of FIG. 7 in the closed position, with the container inverted.
Figure 8:
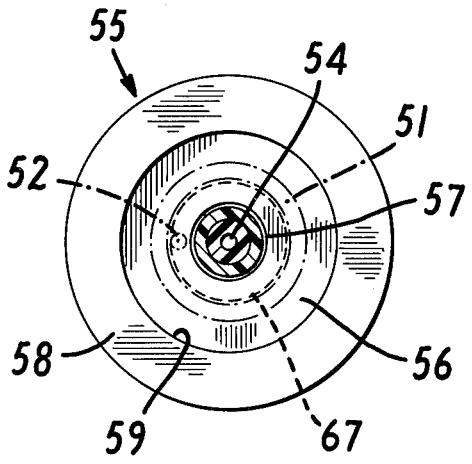
FIG. 8 represents a cross-sectional view taken along line 8—8 of FIG. 7.

The aerosol container shown in FIGS. 7, 7A and 8 is identical to that of FIGS. 5, 5A and 6, except for the shut-off valve of the invention. Therefore, like numbers are used for like parts.

The aerosol delivery valve 40 is of conventional type, with a valve stem 41 having a valve button 42 attached at one end and a flow passage 43 therethrough, in flow communication at one end via port 45 with the interior of a first foam compartment 50 of the container 1, defined by side walls 51, with a gas tap orifice 52 therein. The orifice 52 is 0.10 cm in diameter, and orifice 54 is 0.08 cm in diameter. Both orifices 52, 54 are in flow communication with a second compartment 60, defined by side walls 51 and the outer container wall 64. The valve passage 43 is open at the other end at port 44 via button passage 46 to delivery port 47. The valve button 42 is manually moved against the coil spring 48 between open and closed positions. In the closed position, shown in FIG. 7, the valve port 45 is closed, the valve being seated against the valve seat. In the open position, the valve stem is depressed by pushing in button 42, so that port 45 is exposed, and the contents of the foam compartment are free to pass through the valve passage 43 and button passage 46 out the delivery port 47.

The remainder of the interior of the aerosol container outside the walls 51 and bottom 52 of the foam compartment 50 thus constitutes the second annular propellant compartment 60 surrounding the first. The second compartment 60 contains liquefied propellant (such as a flammable hydrocarbon) with a gas layer above which fills head space 65 over the layer 66 of aerosol composition. A dip tube 62 extends from the liquid tap orifice 54 in foam compartment 50 to the bottom of the container in the propellant compartment 60. Through it, liquid aerosol composition enters the foam compartment at orifice 54, when the valve 40 is opened, and forms a layer therein.

In operation, button 42 is depressed, so that the delivery valve is manipulated to the open position. Liquid aerosol composition is drawn up via dip tube 62 and orifice 54 into foam compartment 50, while propellant gas passes through the orifice 52 and bubbles into aerosol composition in the compartment 50, where it foams the aerosol composition, and then expels the foamed aerosol composition through the passages 42, 46, leaving the container via orifice 47 of the valve as a fine spray.

In this embodiment, aerosol composition and propellant gas are simultaneously introduced into the foam compartment 50 when the button 42 is depressed. The characteristics of the spray that is dispensed depends on the relative rates at which these components are introduced into the foam compartment. Thus, if the proportion of propellant gas to aerosol composition is relatively high, the spray will be moist rather than wet, and the delivery rate will be low. If the proportion of propellant gas to aerosol composition is relatively low, the spray will be wet, and the delivery rate will be relatively high.

The slide valve in accordance with the invention comprises a valve body 55 with a central valve disc 56 and a central aperture 57, and a peripheral rim portion 58 defining a recess 59 above the disc 56. The recess loosely receives the foam chamber walls 51, 53, and permits the valve disc 56 to seat against the wall 53 over the orifice 52, closing it off when the valve disc is in this portion. The aperture 57 loosely receives the dip tube 62. The dip tube thus serves as a central guide for the valve, and the wall 51 an outer guide for the valve. The rim 58 engages the wall 51 over the travel of the valve disc along the dip tube 62 between wall 51 and the stop 67 on the dip tube.

In the normal upright position of the container as shown in FIG. 7, the slide valve is resting on the stop 67. Accordingly, when the button 42 is depressed, liquid aerosol composition can be drawn up through the dip tube 62, and vapor phase propellant from the head space 65 can enter the foam chamber 50 through the vapor tap orifice 52. Thus, the container acts normally when it is in this position, and in fact in all positions where delivery valve 40 is above the horizontal, since the slide valve tends under gravity to remain in the position shown.

When however the container is inverted, as shown in FIG. 7A, so that the delivery valve 40 is below the horizontal, the valve is free to slide along the dip tube 62 to a position abutting wall 53 of the foam chamber 50 and does so, moving the disc valve 56 into place across the orifice 52, closing it off. The valve is held in this position by gravity. In this position, the valve closes off the foam chamber 50 and also the valve stem passage to delivery of liquid. This prevents the escape of liquid propellant through the vapor tap orifice 52 and the delivery port 47, thus avoiding a flammability hazard.

In the aerosol container shown in FIGS. 9, 9A and 10, the capillary dip tube is replaced by a dip tube of normal dimensions, and a restricted tail piece is interposed between the valve and the dip tube to obtain the desired restriction of liquid composition flow towards the valve delivery system of the container when the valve is opened. The shut-off valve of the invention comprises a free-rolling ball in a valve chamber interposed in the dip tube in the line of upstream of the restricted tail piece from the contents of the container.

In this container, the aerosol valve is conventional type, with a delivery valve stem 71 having a valve passage 73, a valve button 72 attached at one end, with valve button passages 76, 77 and a delivery orifice 74 therethrough, and a valve stem orifice 73*a* at the outer end, opening into a delivery valve body 76 pinched by crimps 83*b* in the aerosol container cap 83. The valve body 76 has a blending space 75, which opens at the lower end into the orifice 75*a* of the restricted tail piece 84, and constituting a liquid tap orifice, and at the other end, beyond the delivery valve poppet 78, when the valve is open, into the valve stem orifice 73*a*. The valve poppet 78 is reciprocably mounted at one end of the valve stem 71, and has a socket 78*a* therein for reception of coil spring 88. The poppet is biased by the spring 88 against the valve seat 79 on the inside face of gasket 89 in the normally closed position. The delivery valve is opened by depressing the button actuator 72. When the valve poppet 78 is away from its seat, the valve stem orifice 73*a* is in fluid flow communication with the blending space 75.

The valve housing 90 is provided with a vapor tap orifice 97, which puts the blending space 75 and space 99 in flow connection with the gas or propellant phase in the space 80 at the upper portion of the aerosol container.

The liquid aerosol composition is stored in the lower portion 81 of the container; and the dip tube 85 extends to the bottom of the container through the liquid phase, in flow connection with tail piece orifice 75*b* in tail piece 95 of valve housing 91.

In this aerosol container, the diameter of actuator (valve delivery) orifice 74 is 0.5 mm; the diameter of the valve stem orifice 73*a* is 0.64 mm; the diameter of the vapor tap orifice 82 is 1.0 mm; and the diameter of the tail piece passage 75*b* is 0.89 mm.

In operation, the button 72 is depressed, so that the valve poppet 78 and orifice 73*a* are manipulated to the open position. Liquid aerosol composition is drawn up by the dip tube 85 via the restricted tail piece orifice passage 75*b* into chamber 99 where it is blended with propellent gas entering the space via the vapor tap orifice 97, from the propellant space 80 of the container, and then via orifice 75*a* into the blending space 75. If the chambers 99, 75 are large enough they can serve as a foaming chamber. If it is too small, foaming may not occur. However, the gas ratio is not affected. The blend, in a volume ratio gas: liquid of at least 8, is expelled under propellant gas pressure through the valve stem orifice 73*a*, leaving the container via the stem passage 73, button passages 76, 77 and orifice 74 of the valve, as a fine spray.

The shut-off valve of the invention 90 is interposed across the line of flow from space 81 to blending chamber 75 via dip tube 85, and has a valve housing 91 with a chamber 99 within which is captured a free-rolling ball valve 92, adapted to lodge against either inlet port 93 or outlet port 94. The housing 91 is shaped to fit snugly in a press fit at tubular extension 95 over tail piece 84 and at tubular extension 96 over the end 85*a* of dip tube 85. The sides of the housing 91 taper towards the inlet port 93 and outlet port 94, so as to direct the ball 92 towards the ports as it rolls along the housing, at an angle of about 9° at the center to about 15° near the ports, the angle being taken with reference to the longitudinal axis of the housing 91.

In the upright position of the container, shown in FIG. 9, the ball is at the inlet port 93 end of the housing 91. When the container is tipped towards the horizontal, the taper provides a downhill run for the ball towards the outlet port 94, and as it approaches the port, the taper at the other end directs it to the port 94, so that the ball lodges against the port as shown in FIG. 9A when the container is about in a horizontal position, or below. It remains there, closing the port 94, until the container is tipped far enough to once again result in a downhill run towards port 93, whereupon the ball changes position and lodges against port 93. However, it does not seal off the port 93, because the upstream propellant gas pressure in compartment 81, unlike its behavior at port 94, where upstream pressure presses it against the port, not away from the port, towards an unseated position.

In operation, in the normal upright position of the container, as shown in the drawing, the ball 92 is at the bottom of the chamber 99, resting across port 93. Accordingly, when the button 72 is depressed, the delivery valve 78 is opened, and liquid aerosol composition can be drawn up through the dip tube 85 into the chambers 99, 75, while vapor phase propellant gas from the head space 80 can enter the chambers 99, 75 through the vapor tap orifice 97. Thus, the container acts normally when it is in this position, and in fact in all positions above the horizontal, since the ball then tends under gravity to remain in the position shown.

When however the container is inverted as shown in FIG. 9A, so the delivery valve is below the horizontal, the ball is free to roll along the side walls of the chamber 99, and eventually moves against the port 94, closing it off. It is guided there by the tapered walls of the chamber 99. It is held in this position by the pressure of liquid in the chamber 99 from the dip tube 85. In this position, the ball closes off the delivery valve and the chamber 75 beyond the port 94 from the compartment 81 and the contents thereof, so that delivery of liquid aerosol composition is effectively stopped. This prevents the escape of liquid propellant through the vapor tap orifice 97 and the valve stem passage delivery port 74, thus avoiding a flammability hazard.

The aerosol container of FIGS. 11, 11A and 12 has two porous bubblers 100, 101 interposed at each end of the inner compartment 102 of the container. The first bubbler 100 is in the form of a perforated plate with orifices 104, and the second bubbler 101 is an absorbent porous fibrous nonwoven mat, as in U.S. Pat. No. 3,970,219.

The liquid aerosol composition is retained in the inner compartment 102, to the level shown above the perforated plate 100. Propellant gas in liquefied form is retained in the second compartment 103 outside the first, extending down to the liquid level shown.

When the valve button 106 is depressed and the valve 105 brought to the open position, liquefied propellant volatilizes, and passes in gaseous form through the openings 104 of the perforated plate 100, foaming the liquid in the compartment 102, and driving it upwardly to the absorbent mat 101. The absorbent mat 101 also has a liquid filling the pores 107, and the propellant gas drives this liquid out of the pores, and foams this liquid as well, with the result that a fine spray of foamed aerosol composition is delivered via the valve delivery port 108 while the valve is open.

The shut-off valve of this embodiment is of the same type as in FIGS. 9, 9A and 10, and therefore like numbers are used for the parts thereof. The valve housing 91' in this case has six projections 98' extending inwardly into the chamber 99' about inlet port 93', so as to prevent seating of the ball 92' at the port and thus closing it off. In other respects, operation is similar to that of FIGS. 9, 9A and 10. When the container is tipped towards the horizontal from the upright position shown, the ball 92' eventually has a downhill run towards port 94', and rolls towards it. As it does so, it gathers momentum, which carries it into the seating position shown in FIG. 11A across port 94', closing it off. Then, when the container is returned towards the upright position, the ball eventually has a downhill run towards port 93', and breaks away from port 94', opening the port to flow once again.

The aerosol container of the instant invention can be used to deliver any aerosol composition in the form of a spray. It is particularly suited for use with aqueous solutions, since these are readily compounded to produce a foam. However, any liquid aerosol composition can be foamed, and the container can be used for any liquid aerosol composition. The range of products that can be dispensed by this aerosol container is diverse, and includes pharmaceuticals for spraying directly into oral, nasal and vaginal passages; antiperspirants; deodorants; hair sprays, fragrances and flavors; body oils; insecticides; window cleaners and other cleaners; spray starches; and polishes for autos, furniture and shoes.

Having regard to the foregoing disclosure, the following is claimed as the inventive and patentable embodiments thereof;

1. An aerosol container for use with compositions containing liquefied flammable propellants, and having a shut-off valve closing off flow through an open manually-operated delivery valve whenever the container is tipped from the upright position beyond the horizontal towards the fully inverted position, the container comprising, in combination, a pressurizable container having at least one storage compartment for an aerosol composition and a liquefied propellant in which compartment propellant can assume an orientation according to orientation of the container between a horizontal and an upright position, and a horizontal and inverted position; a delivery valve movable manually between open and closed positions, and including a valve stem and a delivery port; an aerosol-conveying passage in flow connection at one end with the storage compartment and at the other end with the delivery port, manipulation of the delivery valve opening and closing the passage to flow of aerosol composition and propellant from the storage compartment to the delivery port: all flow between the storage compartment and the delivery port preceeding via the aerosol-conveying passage; and a shut-off valve responsive to orientation of the container to move under the force of gravity between positions opening and closing off flow at least of liquefied propellant to the delivery port, the shut-off valve being positioned across the aerosol-conveying passage in the line of flow from the storage compartment to the delivery port, and moving into an open position in an orientation of the container between the horizontal and an upright position, and moving into a closed position in an orientation of the container between the horizontal and an inverted position.

2. An aerosol container according to claim 1, in which the shut-off valve comprises a valve seat, a valve passage through the valve seat, and a free-rolling ball valve adapted to roll into engagement with the valve seat and close off the valve passage at an orientation of the container between the horizontal and an inverted position, and adapted to roll away from the valve seat and open the valve passage at an orientation of the container between the horizontal and an upright position.

3. An aerosol container according to claim 2 in which the delivery valve includes a valve housing receiving one end of a dip tube, and the ball valve, valve passage and valve seat are disposed within the valve housing.

4. An aerosol container according to claim 2 in which the delivery valve includes a foam chamber housing receiving one end of a dip tube, and the ball valve, valve passage and valve seat are disposed within the foam chamber.

5. An aerosol container according to claim 1 in which the shut-off valve comprises a valve seat, a valve passage through the valve seat, and a slide adapted to slide into engagement with the valve seat and close off the valve passage at an orientation of the container between the horizontal and an inverted position, and adapted to slide away from the valve seat and open the valve passage at an orientation of the container between the horizontal and an upright position.

6. An aerosol container according to claim 5 in which the slide valve comprises a valve body having a central disc portion with a central aperture therethrough receiving a central valve guide, and an annular peripheral rim portion embracing an outer valve guide.

7. An aerosol container according to claim 6 in which the delivery valve includes a valve housing receiving one end of a dip tube, the central valve guide is the dip tube, and the outer valve guide is the valve housing.

8. An aerosol container according to claim 7 in which the valve housing includes a vapor tap orifice, and the slide valve in the closed position closes off the vapor tap orifice.

9. An aerosol container according to claim 8 in which the vapor tap orifice is in a bottom wall of the valve housing, and the disc portion closes off the vapor tap orifice.

10. An aerosol container according to claim 8 in which the side wall of the valve housing includes a vapor tap orifice, and the slide valve in the rim portion closes off the vapor tap orifice.

11. An aerosol container for delivering liquid aerosol compositions highly concentrated with respect to the active ingredient at a low delivery rate, comprising, in combination, a pressurizable container having a delivery valve movable between open and closed positions, a valve stem and a delivery port; an aerosol-conveying passage in the valve stem leading to the delivery port; wall means defining a blending space and a storage space and separating the blending space from liquid aerosol composition and propellant within the container; a valve stem orifice in the valve stem in flow connection at one end with the blending space and at the other end with an aerosol-conveying valve stem passage leading to the delivery port; the valve stem orifice having a diameter within the range from about 0.33 to about 0.65 mm; bias means for holding the valve in a closed position; means for manipulating the valve against the bias means to an open position for expulsion of aerosol composition via the valve stem orifice to the delivery port; at least one liquid tap orifice through the wall means, having a cross-sectional open area within the range from about 0.2 to about 0.8 $mm^2$ for flow of liquid aerosol composition from the storage space into the blending space; at least one vapor tap orifice through the wall means, having a cross-sectional open area within the range from about 0.2 to about 0.8 $mm^2$ for flow of propellant from the storage space into the blending space; the ratio of liquid tap orifice to vapor tap orifice cross-sectional open area being within the range from about 0.5 to about 2.5; the open areas of the liquid tap orifice and vapor tap orifice being selected within the stated ranges to provide a volume ratio of propellant gas:liquid aerosol composition within the range from about 8:1 to about 40:1, thereby limiting the delivery rate of liquid aerosol composition from the container when the delivery valve is opened; all flow from the storage space to the delivery port proceeding via the liquid tap orifice or gas tap orifice, blending space and aerosol-conveying valve stem passage to the delivery port; and a shut-off valve positioned across the line of flow between the storage space and the delivery port and responsive to orientation of the container to move under the force of gravity between positions opening and closing off flow at least of liquefied propellant to the delivery port, the shut-off valve moving into an open position in an orientation of the container between the horizontal and an upright position, and moving into a closed position in an orientation of the container between the horizontal and an inverted position.

12. An aerosol container according to claim 11, in which the liquid tap orifice is a capillary dip tube whose cross-sectional open area is within the range from about 0.2 to about 1.8 $mm^2$, for flow of liquid aerosol composition into the blending space; the vapor tap orifice through the wall means has a cross-sectional open area within the range from about 0.2 to about 0.8 $mm^2$ for flow of propellant gas into the blending space; and the ratio of capillary dip tube to vapor tap cross-sectional open area is within the range from about 1.0 to about 3.2.

13. An aerosol container according to claim 11, in which the blending space has a volume of from about 0.1 to about 1 cc.

14. An aerosol container according to claim 11, having a single gas tap orifice and a single liquid tap orifice.

15. An aerosol container according to claim 11, having a tail piece passage as the liquid tap orifice.

16. An aerosol container according to claim 11 in which the container is cylindrical, with the valve at one end, the wall means defining the blending space comprises a concentric inner cylinder spaced from the walls of the container surrounding and housing the valve; the gas tap orifice is through a wall of the inner cylinder; the liquid tap orifice is through a wall of the inner cylinder; and the remainder of the interior of the aerosol container outside the walls and bottom of the inner cylinder comprises an annular compartment for propellant gas and liquid aerosol composition.

17. An aerosol container according to claim 16, having a plurality of gas tap orifices through a wall of the inner cylinder.

18. An aerosol container according to claim 16, comprising a separate compartment for liquid aerosol composition and for propellant, each in direct flow connection with the blending space via the liquid tap and gas tap orifices, respectively.

19. An aerosol container according to claim 16, in which the liquid tap orifice is a capillary dip tube whose cross-sectional open area is within the range from about 0.2 to about 1.8 $mm^2$, for flow of liquid aerosol composition into the blending space; the vapor tap orifice through the wall means has a cross-sectional open area within the range from about 0.2 to about 0.8 $mm^2$ for flow of propellant gas into the blending space; and the ratio of capillary dip tube to vapor tap cross-sectional open area is within the range from about 1.0 to about 3.2.

20. An aerosol container according to claim 16, in which the liquid tap orifice is disposed in a tail piece passage in flow connection to a dip tube.

21. An aerosol container for use with compositions containing liquefied flammable propellants, and having a shut-off valve closing off flow through an open manually-operated delivery valve whenever the container is tipped from the upright position beyond the horizontal towards a fully inverted position, comprising, in combination, a pressurizable container having at least one foam compartment and at least one storage compartment for an aerosol composition and a liquefied propellant in which storage compartment propellant can assume an orientation according to orientation of the container between a horizontal and an upright position, and a horizontal and inverted position; a delivery valve movable manually between open and closed positions, and including a valve stem and a delivery port; an aerosol-conveying passage in the valve stem in flow connection at one end with the foam and storage compartments and at the other end with the delivery port, manipulation of the delivery valve opening and closing the passage to flow of aerosol composition and propellant from the storage compartment via the foam compartment to the delivery port; wall means defining the foam compartment in the container, the foam compartment being in direct flow connection with the aerosol-conveying passage and with the storage compartment; all flow between the storage compartment and the delivery port proceeding via the foam compartment and aerosol-conveying passage in the valve stem; and porous bubbler means having through pores interposed between the foam and storage compartments with the through pores communicating the compartments, the pores being of sufficiently small dimensions to restrict flow of propellant gas from the storage compartment therethrough and form bubbles of such gas in liquid aerosol composition in the foam compartment across the line of flow from the bubbler to the delivery valve, thereby to foam the aerosol composition upon opening of the delivery valve to atmospheric pressure, and to expel foamed aerosol composition through the open valve; and a shut-off valve positioned across the line of flow from the storage compartment to the delivery port and responsive to orientation of the container to move under the force of gravity between positions opening and closing off flow at least of liquefied propellant to the delivery port, the shut-off valve moving into an open position in an orientation of the container between a horizontal and an upright position, and moving into a closed position in an orientation of the container between the horizontal and an inverted position.

22. An aerosol container according to claim 21, in which the porous bubbler has pores of an average diameter within the range from about 0.1$\mu$ to about 3 mm.

23. An aerosol container according to claim 22, in which the porous bubbler has an open area within the range from about 0.005 to about 10 $mm^2$.

24. An aerosol container according to claim 21, in which the porous bubbler is a perforated sheet.

25. An aerosol container according to claim 21, in which the porous bubbler is a wire screen.

26. An aerosol container according to claim 21, in which the porous bubbler is a microporous membrane.

27. An aerosol container according to claim 21, in which the porous bubbler is a sheet of nonwoven fibrous material.

28. An aerosol container according to claim 21, in which the porous bubbler is a sheet of sintered particulate material.

29. An aerosol container according to claim 21, in which the porous bubbler is a filter sheet material.

30. An aerosol container according to claim 21, in which the container is cylindrical, with the valve at one end, and the means defining the first compartment comprises a concentric inner cylinder spaced from the walls of the container surrounding and extending from the delivery valve, and the porous bubbler closes off the other end of the inner cylinder, the remainder of the interior of the aerosol container outside the walls and bottom of the inner cylinder comprising the second annular compartment.

31. An aerosol container according to claim 30, comprising two porous bubblers, one interposed at one end of the first compartment and one interposed in the first compartment adjacent the valve, both being across the line of flow through the first compartment to the valve.

32. An aerosol container for use with compositions containing liquefied flammable propellants, and having a shut-off valve closing off flow through an open manually-operated delivery valve whenever the container is tipped from the upright position beyond the horizontal towards the fully inverted position, the container comprising, in combination, a pressurizable container having at least one foam compartment and at least one storage compartment for an aerosol composition and a liquefied propellant, in which storage, compartment propellant can assume an orientation according to orientation of the container between a horizontal and an upright position, and a horizontal and inverted position; a delivery valve movable manually between open and closed positions, and including a valve stem and a delivery port; an aerosol-conveying passage in the valve stem in flow connection at one end with the foam and storage compartments and at the other end with the delivery port, manipulation of the delivery valve opening and closing the passage to flow of aerosol composition and propellant from the storage compartment via the foam compartment to the delivery port; wall means defining the foam compartment; the foam compartment having a volume of at least 0.5 cc and being in direct flow connection with the aerosol-conveying passage and with the storage compartment; all flow between the storage compartment and the delivery port proceeding via the foam compartment and aerosol-conveying passage in the valve stem; at least one first liquid tap orifice having a diameter within the range from about 0.012 to about 0.2 cm and communicating the foam and storage compartment for flow of liquid aerosol composition into the foam compartment from the storage compartment, and of sufficiently small dimensions to restrict flow of liquid aerosol composition therethrough; the ratio of foam compartment volume/first orifice diameter being from about $10/x$ to about $400/x$, where $x$ is 1 when the orifice length is less than 1 cm, and 2 when the orifice length is 1 cm or more; at least one second gas tap orifice having a total cross-sectional open area within the range from about $7 \times 10^{-6}$ to about $20 \times 10^{-4}$ $in^2$ and communicating the foam and storage compartments for flow of propellant into the foam compartment from the storage compartment therethrough, and of sufficiently small dimensions to restrict flow of propellant gas and form bubbles of such gas in liquid aerosol composition across the line of flow thereof to the valve, thereby to foam the aerosol composition upon opening of the valve to atmospheric pressure, and to expel foamed aerosol composition through the open delivery valve; and a shut-off valve positioned across the line of flow from the storage compartment to the delivery port and responsive to orientation of the container to move under the force of gravity between positions opening and closing off flow at least of liquefied propellant to the delivery port, the shut-off valve moving into an open position in an orientation of the container between a horizontal and an upright position, and moving into a closed position in an orientation of the container between the horizontal and an inverted position.

33. An aerosol container according to claim 32, in which the first compartment has a volume of from 1 to about 4 cc.

34. An aerosol container according to claim 33, having a single second gas tap orifice having a diameter within the range from about 0.003 to about 0.5 inch.

35. An aerosol container according to claim 33, having a capillary dip tube as the liquid tap orifice.

36. An aerosol container according to claim 32, having an orifice in a wall of the foam compartment as the liquid tap orifice.

37. An aerosol container according to claim 32, in which the container is cylindrical, with the delivery valve at one end, and the means defining the first compartment comprises a concentric inner cylinder spaced from the walls of the container surrounding and extending from the delivery valve, the gas tap orifice is through a wall of the inner cylinder, the liquid tap orifice is through a wall of the inner cylinder, and the remainder of the interior of the aerosol container outside the walls and bottom of the inner cylinder comprises the second annular compartment.

38. An aerosol container according to claim 37, having a plurality of gas tap orifices through a side wall of the inner cylinder.

39. An aerosol container according to claim 37, comprising a third compartment for liquid aerosol composition from the second compartment and in direct flow connection with the first separate compartment via the liquid tap orifice.

40. An aerosol container according to claim 37, comprising a capillary dip tube as the liquid tap orifice.

41. An aerosol container according to claim 32, in which the container is cylindrical, with the delivery valve at one end, and the means defining the first compartment comprises a concentric inner cylinder spaced from the walls of the container surrounding and extending from the delivery valve, the gas tap orifice is through a wall of the inner cylinder, a third compartment for liquid aerosol composition in direct fluid flow connection with the first compartment via the liquid tap orifice, and disposed below and concentric with the inner cylinder, and the remainder of the interior of the aerosol container outside the walls and bottom of the inner cylinder and third compartment comprises the second annular compartment.

* * * * *

UNITED STATES PATENT AND TRADEMARK OFFICE

CERTIFICATE OF CORRECTION

PATENT NO. : 4,124,149

DATED : November 7, 1978

INVENTOR(S) : Joseph George Spitzer et al

It is certified that error appears in the above-identified patent and that said Letters Patent are hereby corrected as shown below:

| | | |
|---|---|---|
| [56] Samuelson | : | "1/1970" should be --11/1970--. |
| Column 1, line 18 | : | "Pat." should be --Pats.--. |
| Column 5, line 10 | : | "Nos" should be --No.-- |
| Column 5, line 55 | : | "or" should be --for--. |
| Column 11, line 37 | : | "of", second occurrence, should be --or--. |
| Column 11, line 61 | : | "propellent" should be --propellant--. |
| Column 15, line 51 | : | "repesent" should be --represents--. |
| Column 18, line 7 | : | "orifice" should be --orifices--. |
| Column 18, line 8 | : | "orifices" should be --orifice--. |
| Column 23, line 17 | : | Please insert --of-- after "is". |
| Column 23, line 58 | : | "propellent" should be --propellant--. |
| Column 24, line 27 | : | "the" should be --of--. |
| Column 25, line 66 | : | "preceeding" should be --proceeding--. |
| Column 26, line 31 | : | after "slide", first occurrence, insert --valve--. |

Signed and Sealed this

*Twenty-seventh* Day of *November 1979*

[SEAL]

*Attest:*

RUTH C. MASON
*Attesting Officer*

LUTRELLE F. PARKER
*Acting Commissioner of Patents and Trademarks*